US010399103B2

(12) United States Patent
Lamboux et al.

(10) Patent No.: US 10,399,103 B2
(45) Date of Patent: Sep. 3, 2019

(54) SYSTEM AND METHOD FOR REFILLING A BOTTLE WITH LIQUID

(71) Applicant: TECHNIPLAST, Louviers (FR)

(72) Inventors: Jean-Philippe Lamboux, Saint Didier des Bois (FR); Frédéric Simian, Saint Etienne du Vauvray (FR)

(73) Assignee: TECHNIPLAST, Louviers (FR)

( * ) Notice: Subject to any disclaimer, the term of this patent is extended or adjusted under 35 U.S.C. 154(b) by 57 days.

(21) Appl. No.: 15/737,556

(22) PCT Filed: Jun. 16, 2016

(86) PCT No.: PCT/FR2016/051471
§ 371 (c)(1),
(2) Date: Dec. 18, 2017

(87) PCT Pub. No.: WO2016/203167
PCT Pub. Date: Dec. 22, 2016

(65) Prior Publication Data

US 2018/0141066 A1 May 24, 2018

(30) Foreign Application Priority Data

Jun. 19, 2015 (FR) ..... 15 55668
Jan. 28, 2016 (FR) ..... 16 50700

(51) Int. Cl.
*B05B 11/00* (2006.01)

(52) U.S. Cl.
CPC ..... *B05B 11/0097* (2013.01); *B05B 11/0044* (2018.08); *B05B 11/3001* (2013.01)

(58) Field of Classification Search
CPC ..... B05B 11/0097; B05B 11/0044; B05B 11/3001
See application file for complete search history.

(56) References Cited

U.S. PATENT DOCUMENTS 4,271,875 A * 6/1981 Meshberg ..... B05B 11/0097 141/3
4,917,156 A 4/1990 Varlet

FOREIGN PATENT DOCUMENTS

| | | |
|---|---|---|
| DE | 69308447 | 10/1997 |
| FR | 3003480 | 9/2014 |
| JP | H1119551 | 1/1999 |

(Continued)

OTHER PUBLICATIONS

International Search Report dated Sep. 19, 2016.

*Primary Examiner* — Jason K Niesz
(74) *Attorney, Agent, or Firm* — Ipsilon USA, LLP

(57) ABSTRACT

The invention concerns a system for refilling a bottle with liquid, which comprises:

a first bottle (S) containing liquid, a second bottle (R) to be refilled with the liquid from the first bottle (S), the second bottle being in an inverted position and comprising a pump mounted on the bottle and equipped with a vent orifice that can be open or closed depending on the position of the pump, a filling interface connecting the two bottles, the interface comprising a liquid passage disposed between the two bottles for the transfer of the liquid under pressure from the first bottle (S) to the inverted second bottle (R) via said vent orifice of the pump of the second bottle when open and a gas passage for the evacuation of gas contained in the inverted second bottle (R) to the exterior of the bottle.

21 Claims, 16 Drawing Sheets

(56) References Cited

FOREIGN PATENT DOCUMENTS

| | | |
|---|---|---|
| JP | 2000142852 | 5/2000 |
| WO | 2014199095 | 12/2014 |

* cited by examiner

SYSTEM AND METHOD FOR REFILLING A BOTTLE WITH LIQUID

RELATED APPLICATION

This application is a National Phase of PCT/FR2016/051471, filed on Jun. 16, 2016, which in turn claims the benefit of priority from French Patent application No. 15 55668, file on Jun. 19, 2015 and FR 16 50700, filed on Jan. 28, 2016, the entirety of which are incorporated by reference.

FIELD OF THE INVENTION

The invention concerns a system for refilling a bottle with liquid.

DESCRIPTION OF THE RELATED ART

It is known that bottles containing liquid and equipped with a pump are very difficult or even impossible to refill when the bottle is empty or almost empty and the user wishes to keep it.

Indeed, in the conventional manner, the pumps are mounted on the bottles in such a manner that demounting them without damaging the pumps and/or the bottles is impossible or in any event very difficult.

OBJECTS AND SUMMARY

It would consequently be useful to design a system enabling a bottle equipped with a pump to be refilled without having to remove that pump and without calling into question the very design of bottles already available on the market.

The present invention therefore consists in a system for refilling a bottle with liquid, characterized in that in that it comprises:

- at least one first bottle S containing liquid and comprising a bottom at one end and an opening for the exit of the liquid from the bottle at an opposite end,
- at least one second bottle R to be refilled with the liquid from the first bottle S, the second bottle comprising a bottom at one end and a pump mounted on the bottle at an opposite end, the pump being equipped with at least one vent orifice that can be open or closed depending on the position of the pump, the second bottle R being in an inverted position with the pump situated below the bottom of said bottle,
- a filling interface connecting the two bottles, the interface comprising, on the one hand, at least one liquid passage disposed between the two bottles for the transfer of the liquid under pressure from the first bottle S to the inverted second bottle R via said at least one open vent orifice of the pump of said second bottle and, on the other hand, at least one gas passage P2 for the evacuation of the gas contained in the inverted second bottle R to the exterior of said bottle.

The system according to the invention provides a simple and efficacious way to refill a bottle from another so-called source bottle without having to demount the pump from the bottle to be refilled on the basis of a for example (temporary or permanent) external action on the system. The system does not necessitate designing a specific bottle to be able to refill it. Indeed, to the contrary this system makes it possible to use conventional bottles (at least some of the commercially available standard bottles). The system inverts the bottle to be refilled and uses its pump in the depressed position to introduce into this bottle liquid under pressure coming from the source bottle and passing through a filling interface. The filling interface provides a fluidic connection between the bottles. The liquid can be pressurized in various ways: the pressurization can result from injection of gas into the source bottle, for example one-off injection, from opening the source bottle in which a gas under pressure exerts a permanent pressure on the liquid, from an external action of pumping the liquid contained in the source bottle in order to transfer it under pressure into the interface, etc.

The opening of said at least one first bottle (source bottle) can be situated above its bottom (the normal position of the bottle with the head at the top) or below the bottom (inverted position with the head at the bottom).

According to other possible features, considered separately or in combination with one another:

- the interface is fixed to the first bottle S and/or to the inverted second bottle R;
- the interface is fixed to the inverted second bottle R so as to maintain the pump inserted in said bottle and said at least one vent orifice open;
- the first bottle S comprises a pump mounted on said bottle at the level of the opening, the pump being equipped with at least one vent orifice that can be open or closed depending on the position of the pump;
- the interface is fixed to the first bottle S so as to maintain the pump of said bottle depressed in the latter and said at least one vent orifice open;
- the interface comprises a first attachment part that is fixed to the first bottle S and a second attachment part that is fixed to the inverted second bottle R, the two attachment parts being mobile relative to the interface, for example along the direction of alignment of the bottles and the interface; these mobile attachment parts enable each bottle to be moved relative to the interface and therefore relative to the other bottle;
- the interface is in communication with a dip tube that extends inside the first bottle S and in the direction of the bottom of said bottle;
- the interface comprises at least one gas passage for feeding a gas under pressure to the first bottle S; said at least one passage extends to the first bottle; gas can be injected from outside the interface and such injection of gas can then be considered as an external action on the system; the injection of gas can alternatively be integrated into the interface;
- the system comprises at least one device that is configured to deliver gas under pressure; the gas under pressure is for example delivered/supplied to said at least one gas passage to feed this gas under pressure to the first bottle S; this device can optionally be part of the filling interface and the gas source can optionally be part of the system;
- said at least one device configured to deliver gas under pressure comprises a pumping device for pressurizing the gas and/or a reservoir containing gas under pressure; the pumping device can be manual or electric; said at least one gas passage extends from the pumping device or the reservoir to the first bottle;
- the system comprises a valve that is configured to establish communication with the outside air, on command, of said at least one gas passage that extends to the first bottle S; the valve can be actuated manually or motorized; the valve can be used with the pumping device and, in the event of opening to the outside, establish communication between the gas passage and the interior of the source bottle with the outside or surrounding air, which causes the pressure in the passage and the bottle to fall and interrupts the feeding of gas; the valve can equally be used with the reservoir under pressure and, in the same way, on command, establish communication between the gas passage and the source bottle with the outside or surrounding air; the system is also equipped with another valve which, when open, allows feeding of gas under pressure from the reservoir and, in the closed position, prevents that feeding;

the interface is fixed to the inverted second bottle R and to the first bottle S so as to allow relative movement between the two bottles along the direction of alignment of said bottles and the interface when an external action is exerted in that direction (the external action is for example mechanical);

the first bottle S is equipped with a valve closing the opening and enclosing liquid and a gas under pressure in the bottle, the valve being adapted to be opened by an external action, thus allowing the pressure of the gas to transfer liquid from the first bottle S to the inverted second bottle R;

the interface is disposed between the two bottles;

the interface is disposed between the first bottle S and the inverted second bottle R disposed above the first bottle;

the interface comprises a casing in which are formed housings intended to receive the two bottles.

The invention also consists in a method for refilling a bottle with liquid characterized in that the method is executed by a system that comprises:

a first bottle S containing liquid and comprising a bottom at one end and an opening for the passage of the liquid at an opposite end;

a second bottle R to be refilled with the liquid from the first bottle S and which comprises a bottom at one end and a pump mounted on the bottle at an opposite end, the pump being equipped with at least one vent orifice that can be open or closed depending on the position of the pump, the second bottle R being in an inverted position so that the pump is situated below the bottom of the second bottle;

the method comprising:

opening said at least one vent orifice by depressing the pump in the inverted second bottle R;

creating an increased pressure or a reduced pressure in the first bottle S so as, when the opening of the first bottle allows the liquid to exit said bottle, to cause the transfer of the liquid under pressure from the first bottle S to the inverted second bottle R and the filling of said inverted second bottle R via said at least one open vent orifice;

evacuating the gas (e.g. air) contained in the inverted second bottle R to the outside via the pump.

According to other possible features, considered separately or in combination with one another:

said at least one vent orifice is opened by an external action applied to the pump of the inverted second bottle R;

the external action is applied permanently in order to maintain the pump in the inverted second bottle R depressed during the refilling of said bottle;

the external action is applied repeatedly in order successively to depress the pump in the inverted second bottle R during the refilling of said bottle;

an increased pressure is created in the first bottle S by injection of a gas under pressure into the first bottle S; it is equally possible to establish communication between the interior of the first bottle and the outside air (atmospheric pressure) in order to interrupt immediately the injection of gas under pressure into the first bottle and therefore to interrupt immediately the transfer of liquid under pressure between the bottles; the method generally also commands the stopping of the injection of gas under pressure into the first bottle (for example before or simultaneously with venting).

BRIEF DESCRIPTION OF THE DRAWINGS

Other features and advantages will become apparent in the course of the following description given by way of nonlimiting example only and with reference to the appended drawings, in which.

DETAILED DESCRIPTION

Figure 1C:
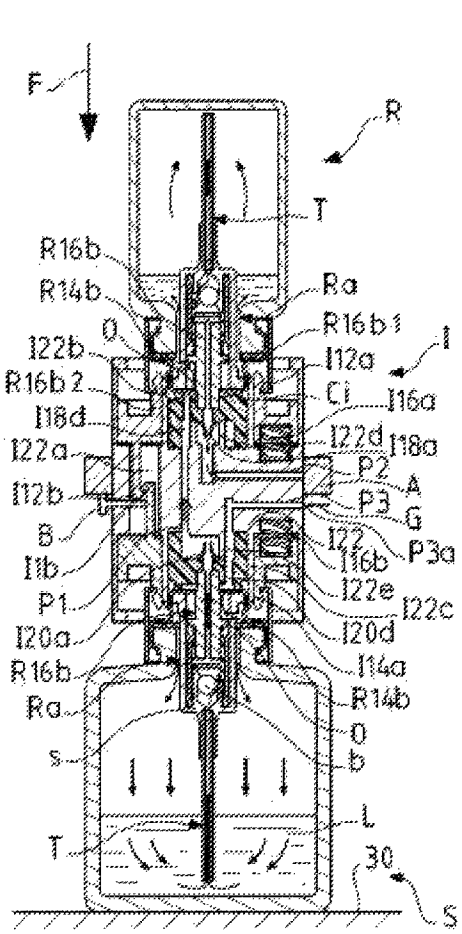
FIGS. 1*a* to 1*c* is show the successive steps of installing a filling interface between two bottles and use of the resulting system according to a first embodiment of the invention to refill a bottle.

The invention that is described hereinafter with reference to the appended drawings notably concerns a system for refilling a bottle and an associated method. The system generally comprises:

at least one first bottle S containing liquid and comprising a bottom at one end and an opening for the exit of the liquid from the bottle at an opposite end, the opening being above or below the bottom depending on the embodiment, at least one second bottle R to be refilled with liquid from the first bottle S (said at least one second bottle, which is empty or almost empty, has already been used to dispense a liquid such as a fragrance or perfume that has been consumed and must be refilled), the second bottle comprising a bottom at one end and a pump mounted on the bottle at an opposite end (not necessarily in a demountable manner), the pump being equipped with at least one vent orifice that can be open or closed depending on the position of the pump (depressed or not depressed i.e. at rest), the second bottle R being in an inverted position with the pump situated below the bottom of said bottle, a filling interface connecting the two bottles. The interface comprises, on the one hand, at least one liquid passage disposed between the two bottles for the transfer of the liquid under pressure from the first bottle S to the inverted second bottle R via said at least one vent orifice of the pump of said second bottle when open and, on the other hand, at least one gas passage for the evacuation of the gas such as air contained in the inverted second bottle R to the exterior of said bottle (it will be noted that the gas contained in the bottle can be an inert gas such as nitrogen). In the absence of action on the system (action such as a mechanical bearing, pressing, etc. force by a user or an external device) there is no transfer of liquid between the two bottles. As will emerge hereinafter, the filling interface can be of very simple design and mainly comprise ducts forming passages for the passage of liquid between the bottles and for the passage of gas (e.g. air) from the bottle to be refilled to the outside.

It will be noted that, depending on the applications envisaged, the system described above can comprise one or more first bottles S (source bottle(s)) and one or more second bottles R (bottle(s) to be refilled). Hereinafter, for simplicity, the system is described with only one first bottle (first type) and only one second bottle (second type) but the description applies equally to a plurality of bottles of the same type.

In the situations described above the interface is adapted to cooperate with a plurality of bottles.

It will equally be noted that the bottles R and S are conventional bottles in the sense that they have not been developed specifically to form part of the system according to the invention. Only the filling interface and its mobile parts/elements, accessories, etc. have been developed specifically for the functionalities of the system.

The system described above can take various forms and for example can be configured with a source first bottle S situated underneath and an inverted second bottle R to be refilled situated above the first bottle with the filling interface disposed between the two (first configuration from FIGS. 1*a* to 10*b*). Alternatively, the system can be configured with a source first bottle S situated alongside an inverted second bottle R to be refilled (second configuration from FIGS. 11*a-b*), the bottom of the inverted second bottle being disposed lower than that of the first bottle (FIG. 11*a*) or higher than that of the first bottle (FIG. 11*b*). According to another alternative linked to the second configuration, the system can be configured with an inverted source first bottle S situated alongside an inverted second bottle R to be refilled (configuration of FIGS. 12*a-b*). The two bottle being disposed side by side, the filling interface is disposed in whole or in part between the two bottles, or even alongside the two bottles or above or indeed below the two or only one of the two. Other configurations not shown can of course be envisaged.

It will be noted that one of the bottles or all the bottles can be inclined to the vertical if the degree of inclination does not impede the operation of the refilling system.

Figure 13A:
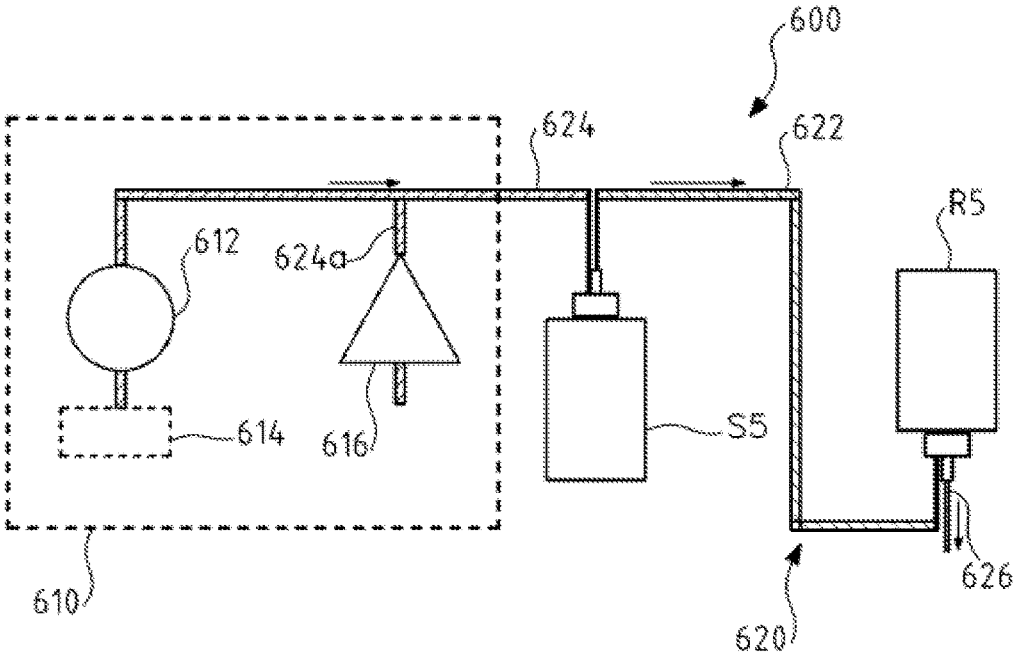
FIG. 13*a* shows diagrammatically a system according to an eighth embodiment of the invention for refilling a bottle.
Figure 13B:
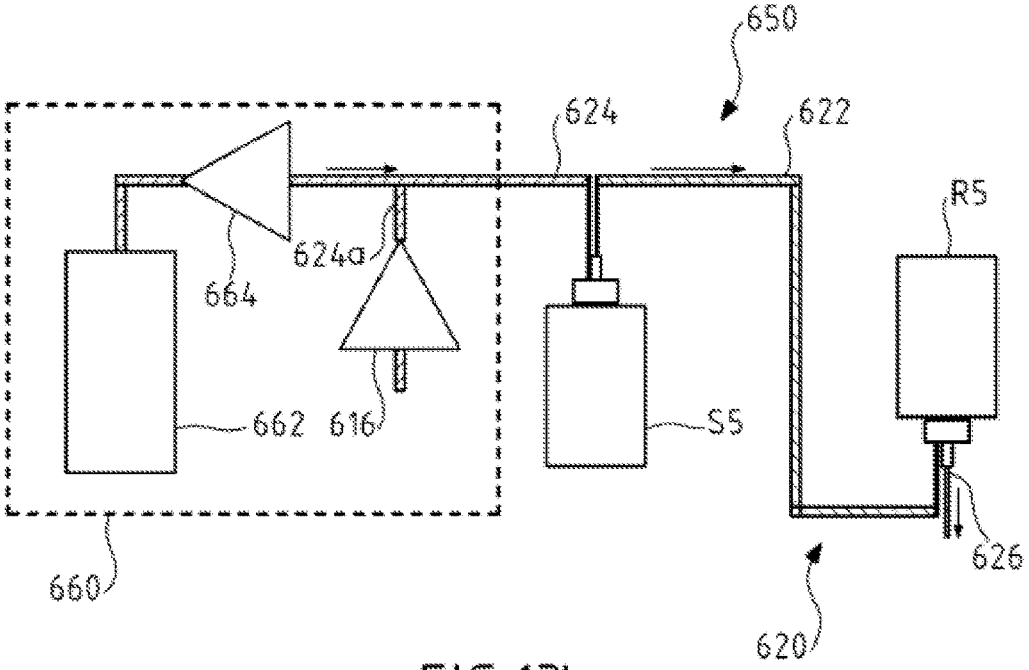
FIG. 13*b* shows diagrammatically a system according to an ninth embodiment of the invention for refilling a bottle.

The foregoing description and in particular the configurations described above apply equally to the systems from diagrammatic FIGS. 13*a* and 13*b*.

A number of embodiments conforming to the first configuration can be envisaged (FIGS. 1*a-c*, 9 and 10*a-b*).

Figure 1B:
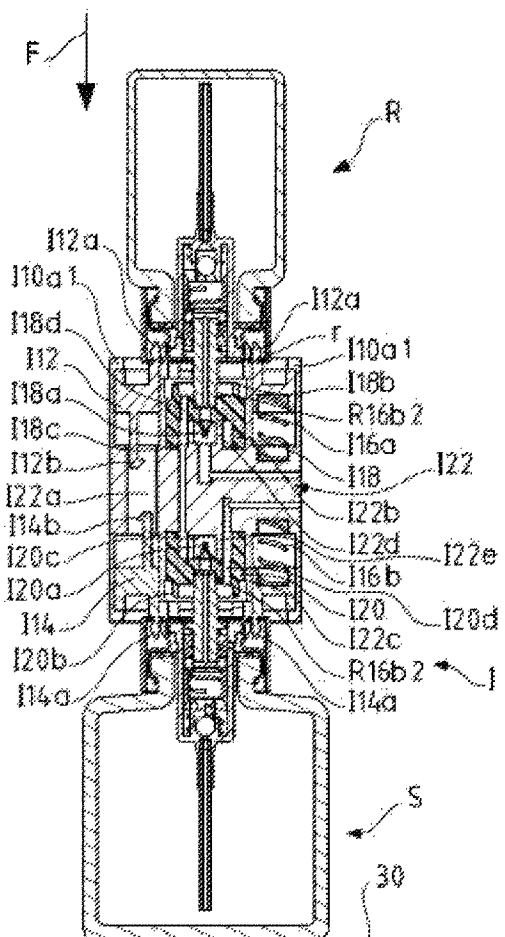
Figure 1A:
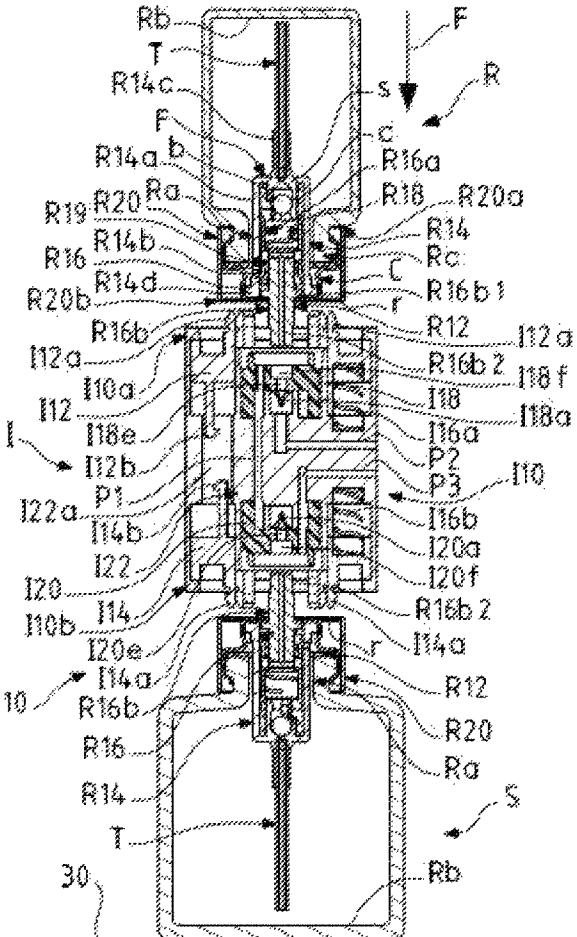

FIG. 1*a* shows a system 10 according to a first embodiment in which the interface I is intended to be fixed to the lower bottle S and to the inverted upper bottle R. These three elements can be separated from one another.

As shown, the second bottle R comprises a pump R12 here mounted in a non-demountable manner on the bottle by means of a crimped capsule C at the open end Ra of said bottle that is opposite the bottom Rb situated at the closed opposite end. According to a variant that is not shown, the pump is mounted in a demountable manner on the bottle.

In the conventional way, the pump R12 comprises a fixed part (body) R14 that is introduced via the opening Ra defined inside the neck Rc of the bottle. The fixed part R14 is fixedly mounted on the bottle by means of the crimped capsule C fixed around the neck Rc. The fixed part R14 extends partly out of the bottle to cooperate with the capsule, for example by means of a shoulder, and partly inside the bottle, where it is extended by a dip tube or suction tube T fixed to the fixed part.

The pump R12 comprises, inside the fixed part R14, a mobile part (piston) R16 that is able to slide axially along the internal face of the fixed part at the same time as ensuring fluid-tight contact between the two parts during this relative movement. The mobile part R16 comprises an internal first portion R16*a* mounted on a return spring R18 that bears on the interior face of the bottom F of the fixed part R14. The mobile part R16 also comprises a second portion R16*b* that extends, on the one hand, partly inside the fixed part and, on the other hand, partly outside it (passing through the capsule C) so that it can be actuated from outside the bottle as explained hereinafter. The second portion R16*b* is mounted to bear on the internal first portion R16*a* by means of a return spring R19. The second portion R16*b* is an elongate piece that has the general shape of a hollow rod. It will be noted that the mobile part R16 can be of unitary construction.

When the bottle is used in the conventional way a button that is not shown is generally mounted around the projecting part of the second portion R16*b* in order to be able to actuate (depress) the rod and therefore the pump from a rest (not depressed) position such as that from FIGS. 1*a-b*. This enables dispensing of the liquid in the conventional way from the bottle R when it contains liquid.

The fixed part R14 comprises a wall R14*a* that is pierced by one or more holes only one of which R14*b* is shown in FIG. 1*a*. This hole or these holes enable communication to be established between a chamber internal to the pump and the interior of the bottle when the internal first portion R16*a* is moved in the direction of the interior face of the bottom F of the fixed part by the action of depressing the rod R16*b* and uncovers the hole or holes R14*b* (FIG. 1*c*).

The bottom F of the fixed part R14 is configured so as to include a valve system comprising a ball b housed in a cage c and a valve seat s provided in said bottom F that is pierced by an opening communicating with the interior of the tube T. The tube T is inserted in a chimney R14*c* extending axially from the exterior face of the bottom F of the fixed part R14 and away from that face in the direction of the bottom Rb of the bottle. The cage c extends axially inside the fixed part from the interior face of the bottom F of the fixed part R14 and away from that face. The return spring R18 is disposed around the cage. The cage c is apertured laterally and can for example be made up of a plurality of separate elements spaced from one another. The height of the cage is adjusted so that the ball b can move axially away from the valve seat s and thus establish communication between the interior of the tube T and the interior of the fixed part R14. However, the ball b remains trapped inside the cage c at the distal end of the latter that is narrower than its base in order to stop the movement of the ball.

The wall R14*a* of the fixed part R14 features a shoulder R14*d* around which the capsule C is mounted.

The part of the second portion R16*b* inside the fixed part R14 comprises a flange R16*b*1 situated at the external periphery of the second portion so as to be held pressed by the springs R18 and R19 against the internal face of the capsule C when the pump is not depressed (FIGS. 1*a* and 1*b*).

The part of the second portion R16*b* outside the fixed part R14 and the capsule C (beyond the flange R16*b*1) comprises a diameter reduction R16*b*2 in the vicinity of its distal end. This diameter reduction R16*b*2 enables creation of one or more vent orifices O between this reduction and an internal peripheral edge Ci delimiting the central opening of the capsule C through which the second portion R16*b* passes when the second portion R16*b* is depressed inside the fixed part R14 (FIG. 1*c*). In this depressed position of the pump the outside of the bottle communicates with the interior of the fixed part R14 of the pump via the vent orifice or orifices O (open orifice(s)) and with the interior of the bottle via the uncovered hole or holes R14*b* in the wall of the pump. This arrangement therefore creates a passage inside the bottle (notably inside the pump) for the passage of compensating outside air in the conventional use of the bottle. However, in the present embodiment this passage is used to feed liquid from the bottle S and thereafter from the interface I to the interior of the bottle R.

It should be noted that other pump configurations can be envisaged with different arrangements for establishing communication between the outside of the bottle and the interior thereof via one or more vent orifice(s).

A piece R20 forming a pump cover is mounted around the capsule C and the neck Rc of the bottle, generally by crimping it on, and is axially open at both its opposite ends so as to be able to have a proximal end R20*a* threaded over the capsule and its opposite distal end R20*b* allow free access to the second portion R16*b* and to a space situated between the piece R20 and the part of the capsule C around the second portion R16*b*. It will be noted that the distal end R20*b* is provided with an internal peripheral rim or return r (FIGS. 1*a* and 1*b*) directed toward the part of the capsule around the second portion R16*b*.

In this embodiment the bottle S has the same pump, crimped capsule and pump cover part structures as the bottle R as described above although this is in no way obligatory. For example, the bottle S can include another type of pump and/or crimped capsule and/or pump cover part, or even neither crimped capsule nor pump cover part or only one of them.

The interface I comprises a structure I10 in which are arranged internal passages or channels passing through the structure and used to circulate liquid (passage(s) P1), air (passage(s) P2) or a gas (passage(s) P3) depending on the passage or passages or channel or channels concerned.

The structure I10 is configured to receive a plurality of mobile attachment parts or pieces intended for the mechanical attachment of the interface to each of the bottles R and S and the attachment of these parts to one another (however, in other embodiments the mobile or non-mobile attachment parts or pieces of the interface are not necessarily attached to one another), together with pieces in contact with the projecting part of the second portion R16*b* of each pump R12 in order to actuate the pump by depressing it. The contact parts also provide the seal function with the bottle concerned.

The receiving structure I10 comprises at each of its two opposite axial ends I10*a*, I10*b* a attachment part or piece I12, I14 mobile relative to the interface and each of which is provided with attachment members of two types:

- attachment members I12*a*, I14*a* (e.g. attachment lugs) facing toward the outside of the structure and that cooperate with one or more complementary attachment elements of each bottle in order to fix the structure of the interface to the bottle concerned by pushing the structure toward the bottle or vice versa; in this example the attachment element is formed by the internal peripheral rim r of the distal end R20*b* in FIG. 1*b* and is inserted in an external groove of an attachment member; this produces a first position of attachment of the interface to the bottles in FIG. 1*b* but the latter is still not yet operational because the pump has not been actuated;
- attachment members I12*b*, I14*b* facing toward the interior of the structure and that cooperate by engagement with the complementary attachment members of the other attachment part or piece; the interengagement of the two attachment parts or pieces I12, I14 is shown in FIG. 1*c*.

It will be noted that each of the two attachment parts or pieces I12, I14 is housed in a peripheral space having a height or axial dimension (as measured along the direction of alignment of the bottles and the interface, this direction coinciding here with the vertical axis) that enables each attachment part to slide axially in the direction of the other part from the position in FIGS. 1*a-b*. In this position the two parts I12, I14 are disposed at the level of the ends I10*a* and I10*b* and are retained there spaced from one another, on the one hand, thanks to elastic members I16*a*, I16*b* (e.g. return springs) mounted between these parts and an internal bearing face of the structure and, on the other hand, thanks to one or more internal returns I10*a*1 (FIG. 1*b*). Each attachment part I12, I14 has a substantially annular shape and includes on each of its two opposite faces the attachment members of the two types described above. When the two attachment parts I12, I14 are moved axially toward each other by an external axial force (e.g. movement of one bottle toward the other and/or movement of the two bottles toward each other), the elastic members I16*a*, I16*b* are compressed until engagement or hooking of the two complementary attachment members I12*b*, I14*b* is achieved, each of which has for example a retaining lug shape (operation of second attachment position from FIG. 1*c*). This enables immobilization of the two attachment parts I12, I14 relative to each other in a second attachment position.

As shown in FIGS. 1*a-c*, the structure I10 of the interface comprises a central block I22 situated between the two attachment parts I12, I14 that comprises at least a part of each of the passages P1 to P3. The block I22 includes an axial through-cavity I22*a* situated at the periphery of the block and into which extends at least a part of the interior attachment members I12*b*, I14*b* so as to allow axial movement thereof by an external action and connection thereof (FIGS. 1*b* and 1*c*).

The structure I10 also comprises two pieces I18, I20 in contact with the (external) projecting part of the second portion R16*b* of each pump R12. Each piece I18, I20 is disposed between one end I10*a*, I10*b* of the structure and the central block I22 in a central region (near the longitudinal, here vertical, axis of the structure) that is surrounded by the corresponding peripheral attachment part I12 or I14. Each piece I18, I20 is installed in a central housing delimited externally by an axial (e.g. cylindrical) wall I22*b*, I22*c* that extends from the central block I22. Each piece I18, I20 is made from a less rigid material than the rest of the structure I10 so as to be able to deform elastically when axially loaded and form a seal. Each piece I18, I20 includes in its central part a channel I18*e*, I20*e* provided at an end facing the block I22 with a lip seal I18*a*, I20*a* which, in the absence of air pressure inside the interface (pressure greater than the external ambient pressure), is closed (check valve). Each piece I18, I20 also includes an annular excrescence I18*b*, I20*b* that extends axially from the face of the piece that is opposite the block I22 in a part of that face that surrounds the central part with the channel. This annular excrescence I18*b*, I20*b* is crushed in contact with the capsule C (FIG. 1*c*), thus providing a sealing function. Each piece I18, I20 has on the side of the face opposite that carrying the annular excrescence a central cavity I18*c*, I20*c* into which the seal I18*a*, I20*a* extends. The central block I22 includes alongside the seal I18*a*, I20*a* one or more projecting elements I22*d*, I22*e* that are intended to support the bottom of each cavity. Each piece I18, I20 also comprises a passage portion I18*d*, I20*d* intended to feed liquid in the case of the piece I18 and to feed gas in the case of the piece I20. Each passage portion I18*d*, I20*d* constitutes a part of the passage P1 and the passage P3, respectively, the other parts of the passage P1 and P3 being integrated into the block I22. The passage P2 is also integrated into the block I22. The piece I18, I20 also comprises at the end of the channel I18*e*, I20*e* opposite that where the lip seal I18*a* I20*a* is located a housing I18*f*, I20*f* the width of which corresponds to the diameter of the size reduction R16*b*2 of the rod R16*b*.

FIGS. 1*a* to 1*c* is show various steps of assembling the system 10 starting from the two bottles R and S and the interface I:

the first bottle S is first placed in the normal position (pump R12 above the bottom Rb), possibly on a support 30, after which the interface I is moved over the bottle S so that the attachment members I14*a* face the axial opening of the pump cover piece R20, notably the internal rim r (FIG. 1*a*); in this position the reduced size projecting part R16*b*2 of the rod R16*b* is disposed facing the housing I20*f* at the inlet of the channel I20*e;* the second bottle R (to be refilled) is moved inverted over the interface I with the pump R12 situated below the bottom Rb of said bottle so that the attachment members I12*a* face the axial opening of the pump cover piece R20, notably the rim r (FIG. 1*a*); in this position the reduced size projecting part R16*b*2 of the rod R16*b* is disposed facing the housing I18*f* at the inlet of the channel I18*e;* the three pieces R, S, I are moved closer to one another on the axis of alignment thereof (by exerting an axial force in the direction of the arrow F, here vertical, to push or press on the bottom of one or both bottles, depending on whether the bottle S is resting on the support 30 or not) in order to nest them two by two thanks to the attachment members I12*a* and I14*a* respectively engaged with the rim r of each piece R20 and retained axially in that position (FIG. 1*b*): the interface I is therefore fixed/attached to the two bottles in a first attachment position (the reduced size projecting part R16*b*2 of each rod R16*b* is engaged in its corresponding housing I20*f*, I18*f*);

an axial or bearing force (an external pressure exerted by a user for example) continues to be exerted in the direction of the arrow F, here vertical, to push on the bottom of the bottle R (the bottle S bearing on the support 30) so as to compress the springs I16*a*, I16*b* in order to cause the two attachment parts I12 and I14 to slide toward one another in their peripheral spaces/housings, thus enabling interengagement of the members I12*b* and I14*b* (FIG. 1*c*); during this axial movement the reduced size projecting parts R16*b*2 of the rods R16*b* are depressed in their corresponding housings I20*f*, I18*f*, abut on the bottom, and then move back inside the fixed part R14 of each pump, compressing the springs R18 and R19, in order to uncover the hole or holes R14*b* and to open/create the vent orifice or orifices O as explained above. At the same time, during this movement the axial extensions I22*b* and I22*c* slide inside and along the respective attachment members I12*a* and I14*a* (FIG. 1*c*) in order to be housed between the latter and the capsule C, thus preventing any radial inward deformation of said attachment members. This arrangement enables the interface I to be locked in its position fixed to each bottle (locked second attachment position). It will be noted that in a variant that is not shown one or more elements for immobilizing/locking the interface can alternatively replace the axial extensions I22*b* and I22*c* in order to retain the attachment members hooked onto the internal rib r.

In this second attachment position each of the two bottles is fixed to the filling interface, maintaining the pump of each bottle depressed in the bottle (vent orifice(s) O open) and the passage normally intended for the compensating outside air open.

In the embodiment shown an increased pressure is created in the bottle S by injection of a gas under pressure (arrow G) into the interface I via the passage/channel P3 (FIG. 1*c*) and then into the bottle S via the orifice O, the hole R14*b*, the opening Ra of the neck and the interior of the bottle, as indicated by the arrows. The liquid L present in the bottle is therefore subjected to the increased gas pressure, which causes it to rise in the tube T, the ball b to be raised above the seat s, the liquid to pass through the valve, the liquid to rise inside the rod R16*b*, through the lip seal I20*a* opened by the pressure of the liquid, the internal cavity situated to the rear and the vertical passage P1 (passage portion integrated into the block I22 and portion I18*d*), then through the orifice O of the bottle R, the hole R14*b*, the opening Ra of the neck and the interior of said bottle R. The liquid therefore leaves the source bottle S and is transferred via the filling interface I to the inverted bottle R to fill it again.

The liquid injected under pressure into the bottle R fills the latter from the neck. The liquid level rises and the internal air is expelled via the tube T, as indicated by the arrows, and then fed through the valve opened by the pressure of the air, the interior of the rod R16*b*, the channel and the lip seal 18*a* opened by the pressure of the air, then the passage P2, before leaving the interface. An absorbent material piece A such as a ring is placed around the structure of the interface at the outlet of the passage P2 (alternatively, the piece is placed against the face including the outlet of the passage P2) in order to absorb any flow of liquid that may occur after all the air from the bottle R has been evacuated to the outside and the liquid level has passed the upper end of the tube T. This piece A is also useful when the pump has not been purged beforehand.

It will be noted that the gas is for example injected at a pressure between 0.1 and 2 bars inclusive, for example 0.5 bar. This gas is generally a gas that does not degrade the composition of the liquid L such as air or a known inert gas (e.g. nitrogen). Means for injection of gas under pressure are described hereinafter with reference to FIGS. 7*a-b*, 8*a-b*.

It will be noted that a deactivation element B (e.g. deactivation finger) is positioned through the external wall of the structure I at the level of a member, namely the member I14*b* for example. Pushing on the deactivation element B enables the member I14*b* to be deformed away from the member I12*b* and therefore release of the interengaged members I12*b* and I14*b*. The action of the springs I16*a* and I16*b* moves the attachment parts I12 and I14 axially away from each other to return to the intermediate position from FIG. 1*b*. The interface is still fixed to the bottles but no longer locked in position.

FIGS. 2*a* to 6*c* described hereinafter are examples of the simplified installation of a filling interface between two bottles with demultiplication of the forces to be applied.

Figures 2A, 2B, 2C:
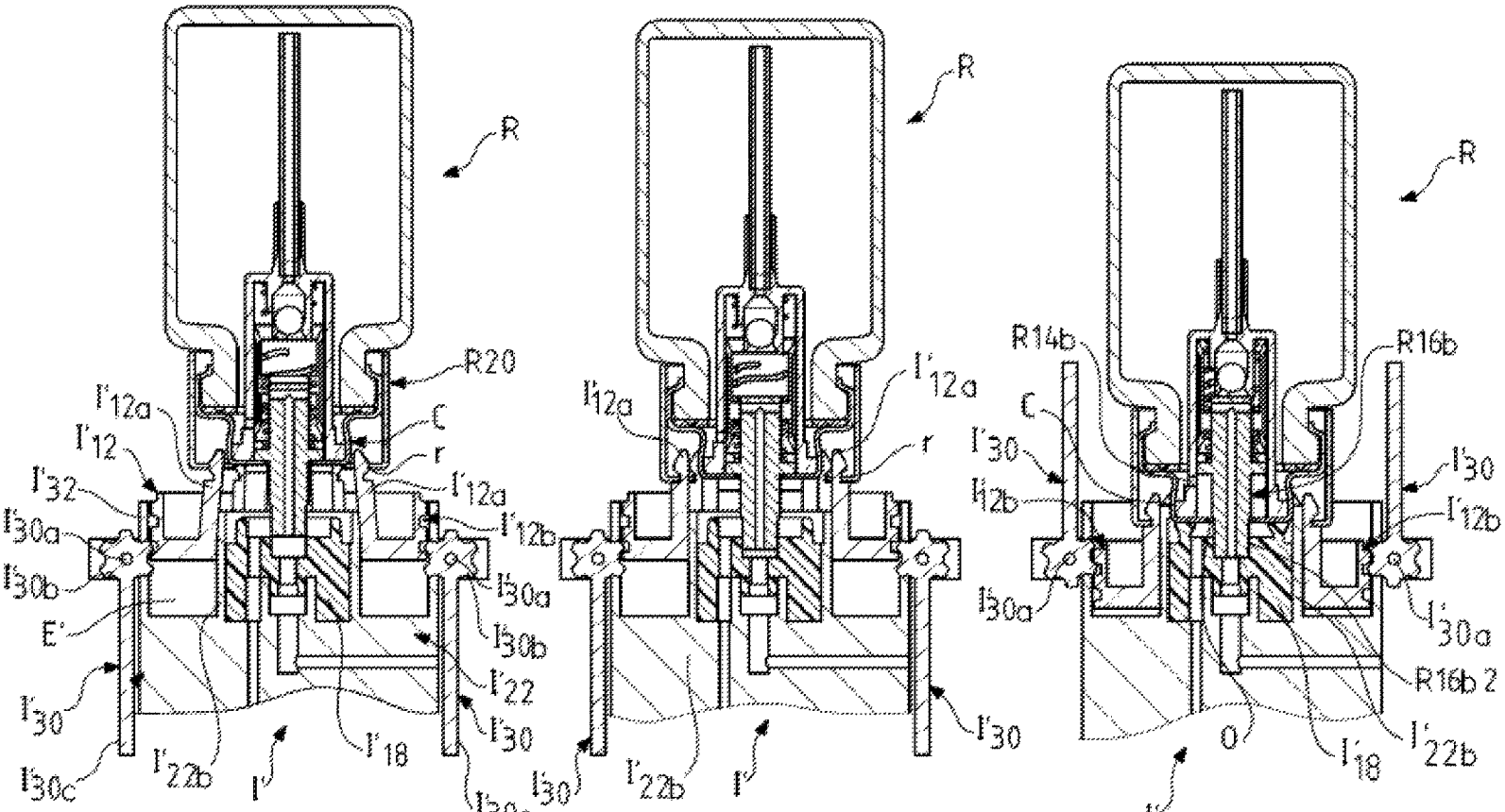
FIGS. 2*a* to 2*c* show a first possible example of a mechanism enabling simplified installation of a filling interface such as that from FIGS. 1*a-c* on at least one of the two bottles.

FIGS. 2*a* to 2*c* show a first possible example of a mechanism enabling simplified installation on at least one of the two bottles R and S of a filling interface I' similar to that from FIGS. 1*a-c*. The following description concerns only the fixing of the interface I' to the inverted bottle R, given that the same mechanism is duplicated for fixing it to the lower bottle S that is not shown. Not all the references shown in FIGS. 1*a-c* are used against here for reasons of clarity but apply except for the attachment parts I12 and I14 and their attachment to each other which no longer take place. Indeed the shape of these parts has been modified and the springs I16*a*, I16*b* have been eliminated.

The interface I' comprises a central block I'22 integrating at least a part of the passages P1 to P3, an elastomer contact piece I'18 similar to the piece I18, surrounded by an axial extension I'22*b* but not including a lip seal (however, in a variant that is not shown this piece can include a seal like the seal I18*a*). The interface comprises a peripheral space or housing E' around the piece I'18 in which is positioned the attachment part I'12 equipped with its attachment members I'12*a*. The attachment part I'12 has an annular shape delimited at its outside periphery by an axial wall or axial elements I'12*b* that are provided with teeth on their external face. The interface also comprises at least one lever, for example two diametrically opposite levers I'30 here that are mounted articulated about a pin I'30*a* perpendicular to the axis of alignment of the interface and the bottle R on the external wall I'32 of the structure I' externally delimiting the space E'. Each lever I'30 (or the single lever) includes a head I'30*b* around the pin I'30*a* and an arm I'30*c*. The external surface of the head perpendicular to the pin I'30*a* is provided with teeth (such as a toothed pinion) that mesh with the teeth on the external face of the axial wall or the axial elements I'12*b* through an opening in the external wall I'32 of the structure I'.

In FIG. 2*a* the levers I'30 are in a lowered position along the external wall I'32 and engaged with one or more teeth of the axial wall or the axial elements I'12*b*. The interface I' and the bottle are moved toward each other and the attachment members (elastic lugs) I'12*a* are deformed elastically into contact with the ring r of the pump cover piece R20 to get past the opening delimited by the external edge of the capsule C and this rim and are engaged with said rim in the retained (attached) position in FIG. 2*b*.

The interface is therefore fixed to the bottle R in a first attachment position that is not yet the locked operational position. The same process is carried out with the lower bottle S that is not shown.

FIG. 2*c* shows the next step during which the levers I'30 are raised (rotating 180° about their pivot pin I'30*a*), which causes the attachment part I'12 to slide downward by virtue of meshing of the teeth on the levers and the teeth on the axial wall or the axial elements I'12*b*. The attachment part I'12 being attached to the piece R20 fastened to the bottle R, the latter is driven downward with the attachment part I'12 (or the interface is driven upward in the direction of the bottle), thus bringing the contact piece I'18 into contact with the reduced size projecting part R16*b*2 of the rod R16*b*. This movement allows depression/actuation of the pump by uncovering the hole or holes R14*b* and opening/creating the vent orifice or orifices O as explained above. As described with reference to FIGS. 1*a-c*, simultaneously with this movement the axial extension I'22*b* is inserted between the attachment members I'12*a* and the capsule C in order to lock the members in position and therefore to lock the interface onto the bottle. The attachment members I'12*a* are therefore locked onto the bottle via the piece R20. This produces a second attachment position of the interface locked to the bottle in which the pump is now actuated (permanently). The same process is carried out with the lower bottle S that is not shown. The system is rendered operational, ready to transfer liquid under pressure from the bottle S to the bottle R by injection of gas under pressure. The lever means described (lever(s) driven by gears) and their use enable (thanks to a force demultiplication effect) any user easily to actuate the pump of each bottle (moving the pump to the low or depressed position generally necessitates a force of the order of 3 to 4 kg or higher) and to obtain fluid tightness with the piece I'18 forming a seal. The levers I'30 have locking and unlocking positions along the interface, which therefore does not cause any external bulk liable to be a nuisance to the user. The same process is carried out with the lower bottle S that is not shown.

The operation of the system installed in this way is identical to that described for the embodiment of FIGS. 1*a-c* and will therefore not be repeated here.

It will be noted that the interface is unlocked from the bottle in the reverse manner by lowering the levers I'30 and returning them to the FIG. 2*a* position.

Figure 3B:
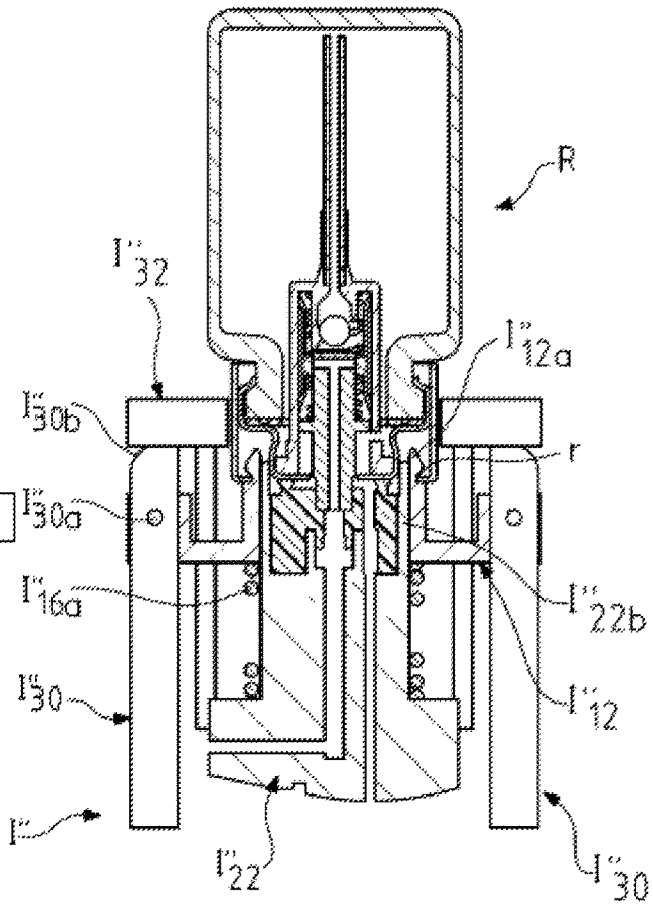
FIGS. 3*a* and 3*b* show one possible variant of the simplified installation mechanism from FIGS. 2*a* to 2*c;*
Figure 3A:
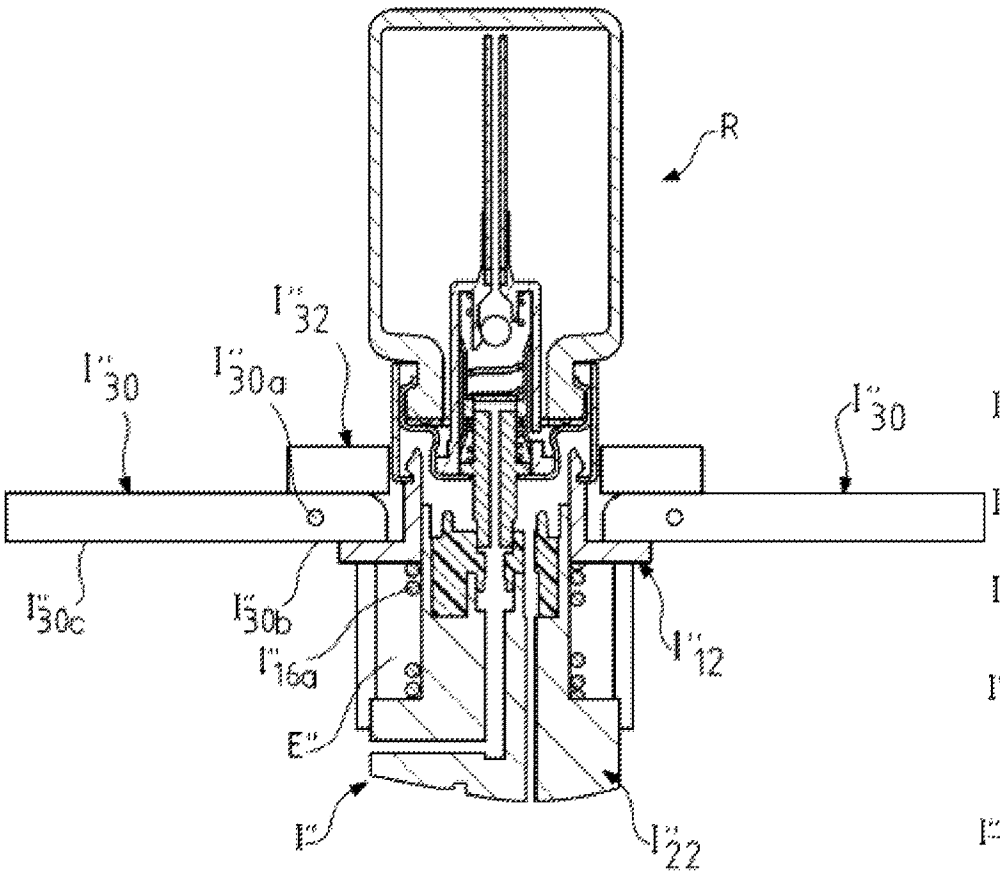

FIGS. 3*a* and 3*b* show a possible variant of the simplified installation mechanism from FIGS. 2*a* to 2*c*. The mechanism from FIGS. 3*a-b* uses a lever system without gears.

The system from FIGS. 3*a-b* differs from that from FIGS. 2*a-c* by the following elements of the interface I":

- the attachment part I"12 is mounted on a spring I"16*a* (or any other elastic member providing the same function) and is able to slide axially in the peripheral space E" formed above the central block I"22;
- two levers or arms I"30 are inserted via their head I"30*b* which is mounted to pivot about the pin I"30*a* between said attachment part I"12 and an upper bearing piece I"32 fixed to the central block I"22 (in a variant the bearing piece could be integral with the block); each lever is fastened to the attachment part I"12 by means of its pin I"30*a* and is able to pivot about the pin relative to said part I"12; the head of each lever has an external face a part of which is curved at its end. A single lever can be envisaged in a variant that is not shown.

In the FIG. 3*a* position the two levers I"30 are in a horizontal waiting position and the interface I" is fixed to the inverted bottle R as already shown in FIGS. 2*a-c* (first attachment position). In this position the external face of the head I"30*b* of each lever bears against the lower face of the upper bearing piece I"32.

To lock the interface to the bottle (in order to actuate/depress the pump) in a simple manner and without excessive force the user grasps the two levers I"30 and pivots them downward (in the manner of the movement of the arms of a corkscrew) as shown in FIG. 3*b* (the force to be exerted by the user is demultiplied). During this movement the head I"30*b* of each lever bears against the lower face of the upper bearing piece I"32, thus exerting a lever effect thereon. The lever bearing thereon in this way is lowered and therefore drives in translation the attachment part I"12, which compresses the spring I"16*a*. As the attachment part I"12 is attached to the bottle, this movement induces relative movement between the bottle and the interface, notably the central block I"22. As in the other embodiments, the axial extension I"22*b* locks the interface position by holding the attachment members pressed against the rim r. The pump is actuated as already described with reference to FIGS. 2*a-c*. The levers I"30 are in the locking position arranged along the interface, which therefore causes no external bulk liable to be a nuisance to the user. The same process is carried out with the lower bottle S that is not shown.

The operation of the system installed in this way is identical to that described for the embodiment from FIGS. 1*a-c* and will therefore not be repeated here.

It will be noted that the interface is unlocked from the bottle in the reverse manner by raising the levers I"30 to return them to the FIG. 3*a* position.

FIGS. 4*a* to 4*d* show a second possible example of a simplified mechanism for installing on at least one of the two bottles R and S a filling interface I'" similar to that from FIGS. 1*a-c*.

The bottle R' includes the same elements as the bottle R except for the capsule C and the pump cover piece, which are absent (in a variant that is not shown there could nevertheless be a crimped capsule and even an appropriate pump cover). The rod R'16*b* is retained inside the fixed part R'14 by a retaining element that is not shown. The pump is also retained in the bottle by a retaining element that is not shown.

The interface I'" has a structure comprising a central block I'"22 with the integral passages P1 to P3 not shown completely here. The structure is extended on either side of the block by an annular wall I'"32 delimiting an internal space E'" (only the upper wall is shown here).

A contact and sealing piece I'"18 similar to the piece I18 from FIGS. 1*a-c* is disposed at the centre of the space E'" in a housing delimited externally by an axial cylindrical extension I'"22*b* of the block. The contact and sealing piece I'"18 is hollow and its central part bears on a support I'"22*c* enclosing a compression spring I'"22*d*.

The piece I'"18 is pierced on the one hand at the centre by a channel I'"18*e* aligned with the spring I'"22*d* and with the inlet of the passage P2 and on the other hand at the periphery by a channel I'"18*d* that is part of the passage P1.

The annular wall I'"32 is provided on its internal face that faces toward the internal space E'" with an internal screwthread I'"32*a*.

An intermediate piece B10 having an annular general shape is provided on its external face with a screwthread B10*a* complementary to the screwthread I'"32 for fixing it to the interface. The piece B10 is an attachment piece or part mobile relative to the interface the role of which is to attach the interface to the bottle.

The piece B10 includes an internal face configured to house a single piece or a plurality of pieces spaced along a circumference and each made from a soft (flexible) and adherent material B12. For convenience, in the remainder of the description this piece consists of an adhesive ring B12. The material exercising the adhesion function is for example an elastomer or a foam.

The piece B10 comprises a low part B10*b* continuous over all its circumference and a high part B10*c* that is not continuous over all its circumference so as to form a plurality of portions spaced from one another along the circumference.

Figures 4A, 4B, 4C, 4D:
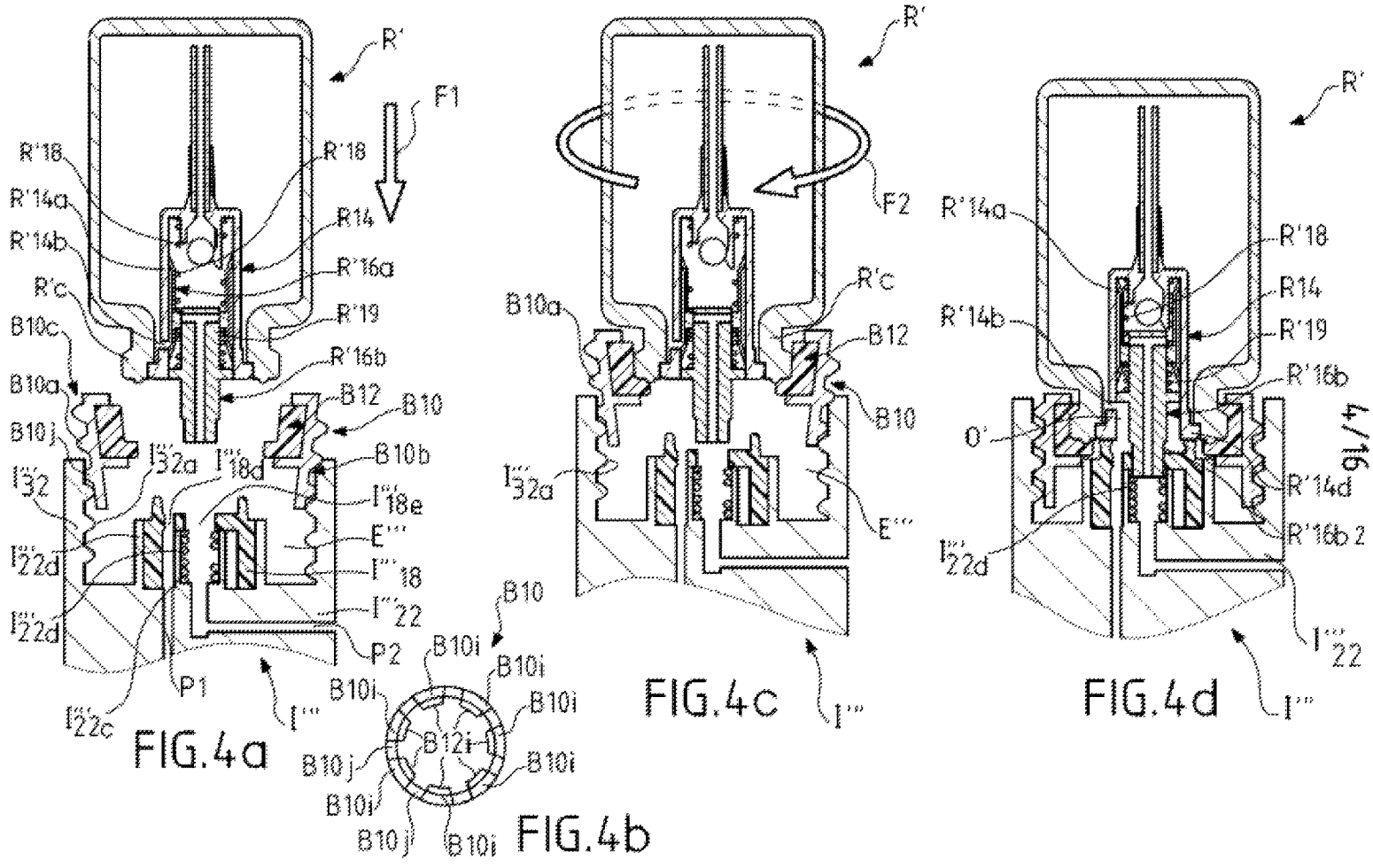
FIGS. 4*a* to 4*d* show a second possible example of a simplified mechanism for installing a filling interface such as that from FIGS. 1*a-c* on at least one of the two bottles.

FIG. 4*b* shows from above the intermediate piece B10 with upper portions B10*i* regularly spaced along the circumference of the piece and mounted on a common annular support B10*j* visible between the portions B10*i*. These portions B10*i* form elastic lugs which are spread outward in the rest position (FIG. 4*a*). In that figure the common annular support B10*j* is screwed partially into the wall I'"32 of the interface in order to retain only the piece B10.

The adhesive ring B12 comprises a plurality of pieces B12*i* spaced circumferentially in FIG. 4*b* and firmly fastened, for example glued, to the internal faces of the portions B10*i*. The pieces B12*i* form adhesive pads.

As shown in FIG. 4*a*, the bottle R' is disposed above the intermediate piece B10 mechanically engaged in the interface. The bottle is moved downward (in translation) in the direction of the arrow F1 in the direction of the piece B10 so that the external face of the neck R'c of the bottle (e.g. here its external shoulder) comes into contact with the adhesive ring B12, more particularly its pads B12*i*. The adhesion of the neck to the pads enables immobilization of the bottle relative to the intermediate piece B10. The user then turns the bottle in the direction of the arrow F2 in order to screw said piece B10 (driven in rotation through adhesion) into the interface, in the space E'". When screwing the screwthread B10*a* into the screwthread I'"32*a*, the portions B10*i* carrying the adhesive pads B12*i* are pressed radially in the direction of the centre of the piece B10 and therefore of the neck R'c. The adhesive pads B12*i* made from a soft material are deformed around the neck R'c, while the piece B10 and the bottle descend toward the central block I'"22. The piston R'16*b* (hollow rod) is retracted inside the fixed part R'14 and compresses the springs R'18 and R'19 when the end of the smaller size projecting part R'16*b*2 is engaged in the channel I'"18*e* and is subjected to the action of the spring I'"22*d* (it will be noted that this ring or any other elastic member enables any variations of the axial dimension to be absorbed). The hole R'14*b* is therefore uncovered and the vent orifice O' is created. Here this orifice is formed by the annular space around the piston and delimited externally by the shoulder R'14*d* of the wall R'14*a*. The aforementioned arrangement does not cause any external bulk liable to be a nuisance for the user. The same process is carried out with the lower bottle S that is not shown and which in this example is (optionally) without a capsule and pump cover piece.

The operation of the system installed in this way is identical to that described for the embodiment from FIGS. 1*a-c* and will not be repeated here.

The interface is fixed to the bottle in a different way with a demultiplied force (of axial depression and screwing). Fixing does not involve two attachment positions as before but a single position that is the locked attachment position (FIG. 4*d*). The fixing of the interface to the bottle calls for one or more gestures to which the user is accustomed, which renders the manipulation particularly easy. This embodiment enables fixing to a filling interface of bottles with no pump cover piece.

It will be noted that the interface is unlocked from the bottles in the reverse manner by unscrewing each bottle in order to return successively to the positions from FIGS. 4*c* and 4*a*.

FIGS. 5*a-d* show a first possible variant of the system from FIGS. 4*a-d* for fixing an interface I'" to an inverted upper bottle R". This bottle is almost identical to the bottle R from FIGS. 1*a-c* except for two diametrically opposite areas R"d on its exterior surface that are configured to facilitate grasping the bottle between the fingers of a user. Here these areas R"d correspond to depressions (or imprints) but they could be grooved areas, areas textured other than by means of grooves, in addition to or instead of the depressions. The bottle R" includes a crimped capsule C and a pump cover piece R20.

The interface I"" includes an intermediate attachment part or piece I""12 (mobile relative to the interface) that combines the function of attachment of the pieces I12 and I'12 from FIGS. 1*a* to 3*b* and of attachment of the intermediate piece B10 from FIGS. 4*a-d* with its adhesion function (adhesive rings/adhesive pads).

The intermediate attachment piece I""12 includes attachment members I""12*a* identical to the attachment members I12*a* (FIGS. 1*a-c*) and intended to clip over the internal rim r of the piece R20.

Figures 5A, 5B, 5C, 5D:
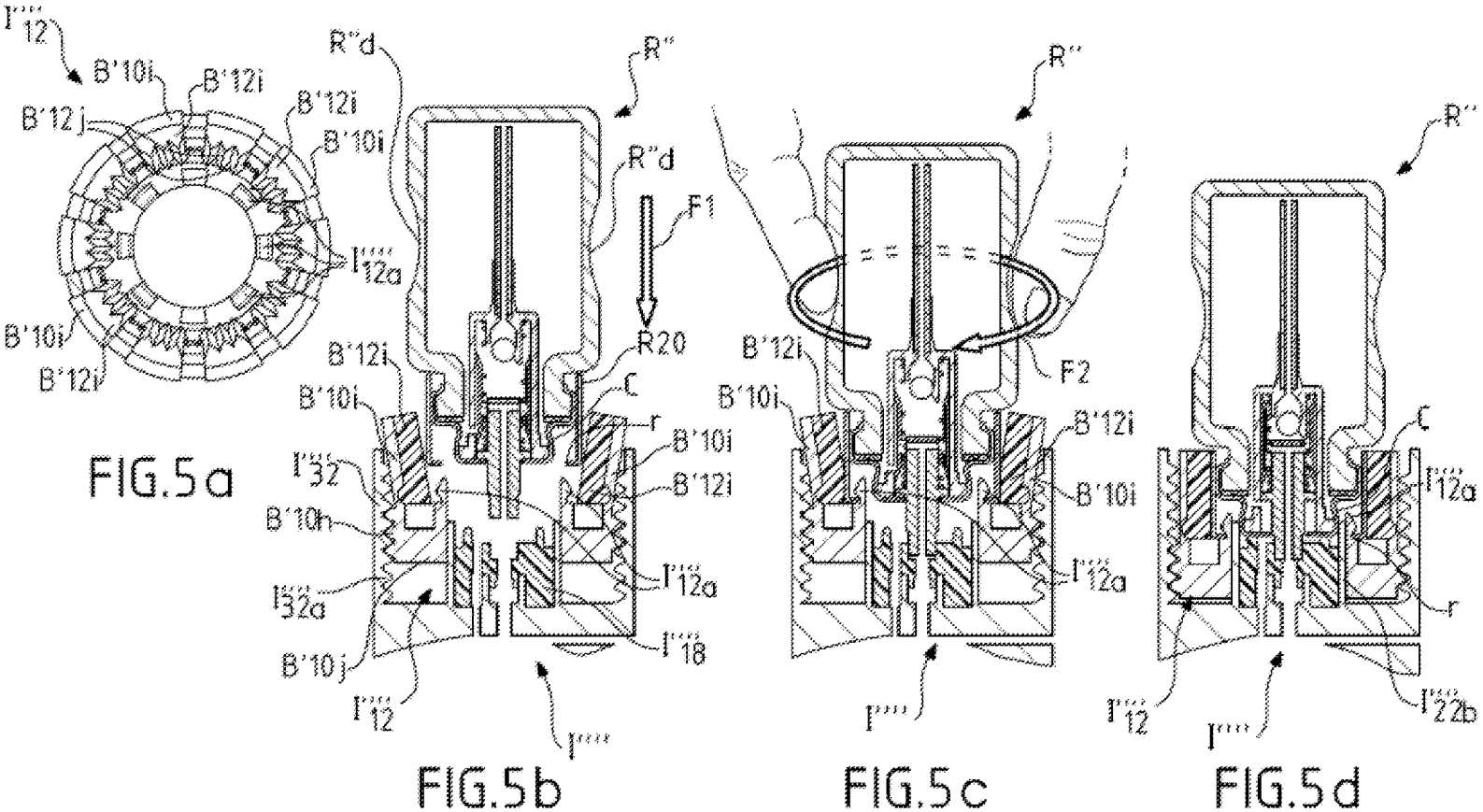
FIGS. 5*a* to 5*d* show a first possible variant of the simplified installation mechanism from FIGS. 4*a* to 4*c;*

The intermediate attachment piece I""12 shown separately from above in FIG. 5*a* includes upper portions B'10*i* regularly spaced along the circumference of the piece and mounted on a common annular support B'10*j* visible between the portions B'10*i*. These portions B'10*i* form elastic lugs which spread outward in the rest position (FIGS. 5*a-b*). In FIG. 5*b* the common annular support B'10*j* provided with a screwthread B'10*h* on its exterior face is screwed partly into the wall I""32 of the interface (having on its internal face a complementary screwthread I""32*a*) in a waiting position.

The adhesive ring in FIG. 5*a* comprises a plurality of circumferentially spaced pieces B'12*i* firmly fixed, for example glued, to the internal faces of the portions B'10*i*. The pieces B'12*i* form adhesive pads made for example from the same material as the system from FIGS. 4*a-d*. Unlike the system from FIGS. 4*a-d*, the pads B'12*i* have grooves B'12*j* that are axial relative to the revolution axis of the piece I""12. These grooves are disposed along the insertion axis of the bottle (axis of the arrow F1 in FIG. 5*b*) in order to facilitate the insertion movement in translation of the bottle. As for the system from FIGS. 4*a-d*, each pair of pads and portion B'10*i* could be in one piece fastened to the common annular support B'10*j*.

The common annular support B'10*j* includes on its internal face the attachment members I""12*a* respectively disposed in radial corresponding relationship to the pads B'12*i*. A radial space is formed between these attachment members I""12*a* and the axial grooves B'12*j* of the pads to allow the passage of the internal rim r of the capsule (FIG. 5*c*). It will be noted that the sealing piece I""18 is identical to the piece I'18 from FIGS. 2*a-c*.

As shown in FIGS. 5*b* to 5*d*, the user axially inserts the bottle R' in the downward direction of the arrow F1 between the pads B'12*i* of the intermediate attachment piece I""12 (the user can optionally hold the bottle by the areas R"d) to bring the pump cover piece R20 into contact with the adhesive material constituting the pads B'12*i* and to insert the internal rim r in the external groove of the attachment members I""12*a* (first attachment position from FIG. 5*c*). In this position the piece R20 is abutted axially against the intermediate attachment piece I""12 via the attachment members. The user grasps the bottle with their fingers in the two areas or imprints R"d to turn (as shown by the arrow F2) the bottle adhering to the intermediate attachment bar I""12 (the two elements constrained to rotate together) and thus to screw the latter into the interface I"". During this screwing step, the portions B'10*i* provided with the pads B'12*i* (flexible lugs) are pressed radially onto the piece R20 and the intermediate attachment piece I""12 descends in the open peripheral space of the interface, while the axial extension I""22*b* of the interface is inserted into the radial space between the attachment members I""12*a* and the capsule C (FIG. 5*d*) to prevent any radial deformation of said members because of the screwing action that has just been described. This arrangement therefore enables the interior of the flexible lugs I""22*b* to be locked onto the piece R20 (and therefore the interface to be locked onto the bottle) by maintaining the pump actuated (depressed or low position when the bottle is in the normal position). FIG. 5*d* shows the locked position of the system in which the bottle R" can be filled again (given that the interface has also been fixed in an identical manner to the lower bottle S that is not shown).

The operation of the system installed in this way is identical to that described for the embodiment from FIGS. 1*a-c* and will not be repeated here.

It will be noted that the interface is unlocked from the bottles in the reverse manner by unscrewing each bottle in order to return successively to the positions from FIGS. 5*c* and 5*b*.

Figures 6A, 6B, 6C:
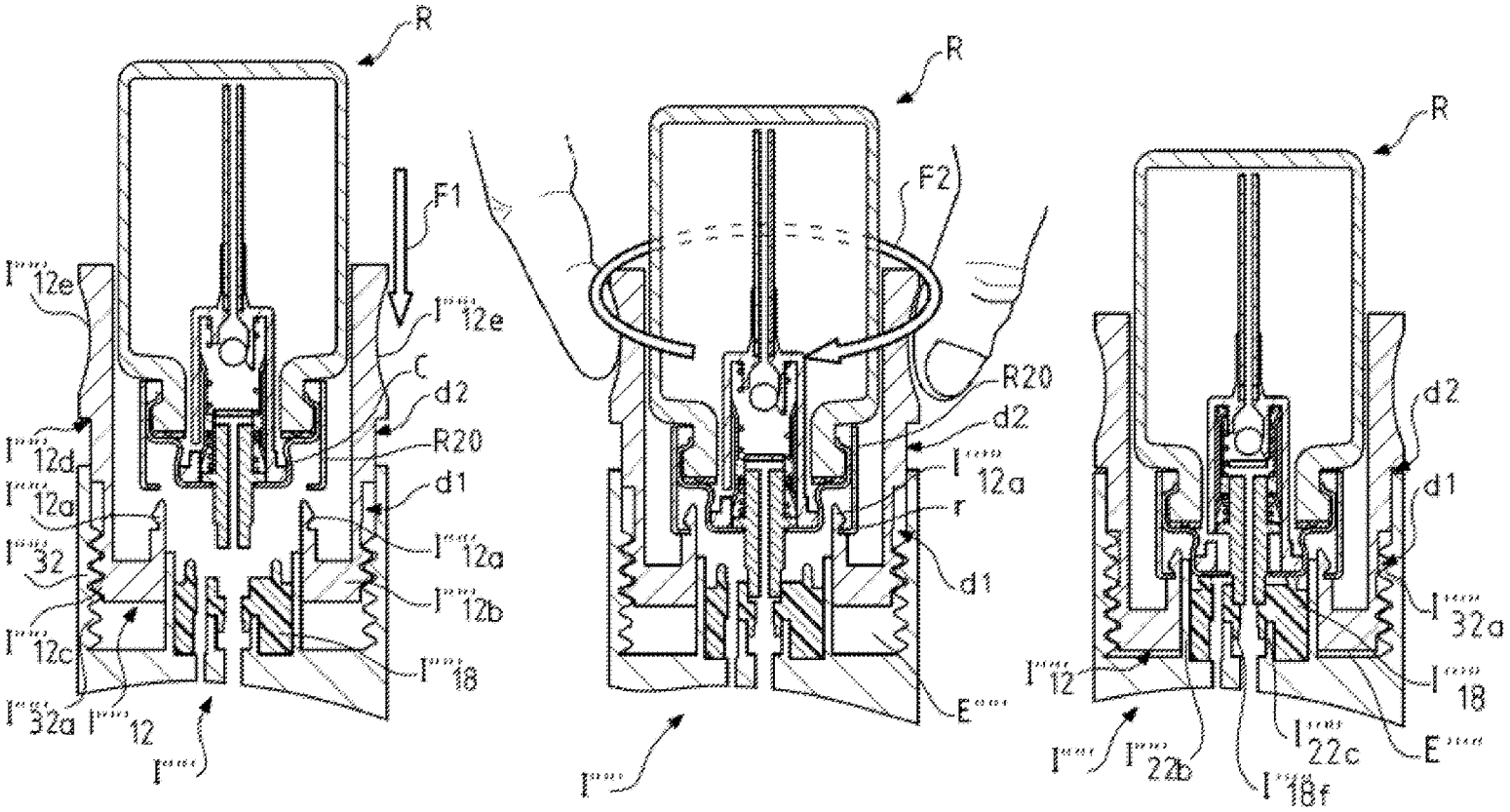
FIGS. 6*a* to 6*c* show a second possible variant of the simplified installation mechanism from FIGS. 4*a* to 4*c;*
Figure 7A:
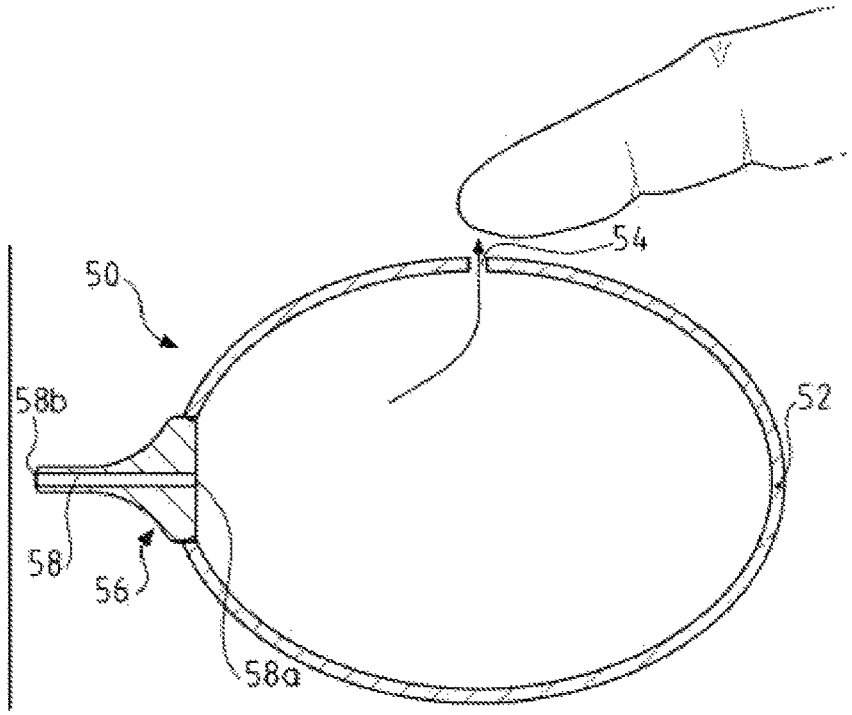
FIGS. 7*a* and 7*b* show a first possible example of a device for injecting gas under pressure cooperating with the interface from FIGS. 1*a-c;*
Figure 7B:
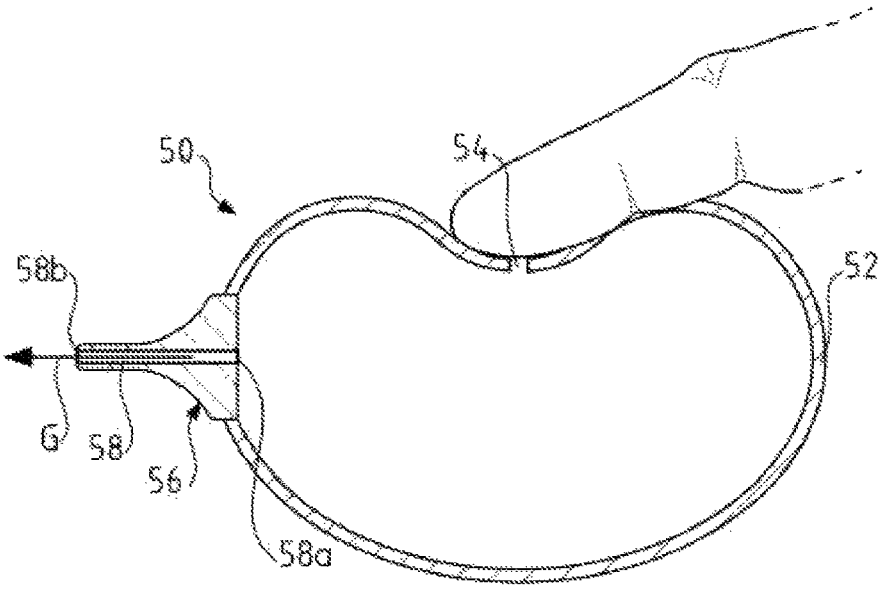

FIGS. 6*a-c* show a second possible variant of the system from FIGS. 4*a-d* for fixing an interface I"" to an inverted upper bottle R identical to the bottle R from FIGS. 1*a-c*. The system from FIGS. 6*a-c* does not include an adhesive material but instead an attachment piece I""12 the base I""12*b* of which is identical to the common annular support B'10*j* from FIG. 5*b* and includes attachment members I""12*a* and an external screwthread I""12*c* cooperating with the internal screwthread I""32*a* of the wall I""32.

However, the attachment piece I""12 mobile relative to the interface is extended axially upward by an axial extension I""12*d* that notably projects beyond the interface and is provided on the exterior surface of its upper free end with two diametrically opposite areas I""12*e* that are configured to facilitate grasping of the piece by the fingers of a user.

Here these areas I""12*e* correspond to depressions (or imprints) in the end that is thicker than the rest of the extension. However, these could be grooved areas, areas textured other than by grooves, etc. in addition to or instead of the depressions. The radial extension I""12*d* of the attachment part I""12 defines an upper axial internal housing at the bottom of which are disposed the attachment members I""12*a*. The diameter of this housing enables the bottle R to be received in it.

The axial extension I""12*d* has on its exterior surface two steps d1, d2 offset axially and radially relative to one another. The first step d1 enables the attachment piece I""12 to descend into the peripheral space E"" without mechanical interference with the internal screwthread I""32*a* (FIG. 6*c*).

The second step d2 enables the attachment part I"12 to descend into the peripheral space E"" guided by the internal surface of the wall I""32.

In the position from FIG. 6*a*, the attachment part I""12 is partly screwed into the wall I""32 of the interface (in the upper part of the screwthread I""32*a*) in a waiting position.

As shown in FIGS. 6*a* to 6*c*, the user inserts the bottle R axially downward in the direction of the arrow F1 into the upper axial internal housing (FIG. 6*a*) of the attachment piece I''''12 to insert the internal rim r of the capsule into the external groove of the attachment members I''''12*a* situated at the bottom of the housing (first attachment position from FIG. 6*b*). In this position the piece R20 is axially abutted against the intermediate attachment piece I''''12 via the attachment members I''''12*a* and is immobilized against movement in translation thereon. The user grasps the axial extension (sheath) I''''12*d* with their fingers in the two areas or imprints I''''12*e* and presses down and turns the intermediate attachment part I''''12 (in the direction of the arrow F2 from FIG. 6*b*), the effect of which is to screw it into the wall I''''32 of the interface I'''', thus driving the bottle downward in translation into the space E''''. Simultaneously the axial extension I''''22*b* of the interface is engaged between the attachment members I''''12*a* and the capsule C in order to prevent any radial deformation/movement of said members in the direction of the capsule in order to be disengaged from the internal rim r. On completion of this screwing step the piece I''''32 is at the bottom of the space E'''', the pump is actuated (depressed or low position when the bottle is in the normal position) and the attachment members I''''12*a* (flexible lugs) are locked in the attachment position.

FIG. 6*c* shows the locked position of the system in which the bottle R can be filled again (if the interface has also been fixed and locked in the identical manner to the lower bottle S that is not shown).

The operation of the system installed in this way is identical to that described for the embodiment from FIGS. 1*a-c* and will not be repeated here.

It will be noted that the interface is unlocked from the bottles in the reverse manner by unscrewing each bottle in order to return successively to the positions from FIGS. 6*b* and 5*a*.

The system from FIGS. 6*a-c* is useful if there is grease on the pump cover piece R20. Indeed, in a system of this kind the system from FIGS. 5*a-d* offers lower performance because the adhesion necessary to rotate the bottle is more difficult to obtain. The system from FIGS. 6*a-c* circumvents this difficulty as the screwing force is no longer exerted directly on the pump cover piece R20 or on the body of the bottle (the user is no longer in direct contact with the bottle) but on an intermediate piece attached to the internal rim of the pump cover piece R20 (the intermediate attachment piece I''''12 is removable from the interface, as in the embodiments from FIGS. 2*a-c*, 4*a-d* and 5*a-d*). Accordingly, even if there is grease on the exterior surface of the body of the bottle, installation of the system is very effective.

It should be noted that the contact and sealing piece I''''18 (identical to the piece I''''18 from FIGS. 5*b-d*) provides two functions where the system from FIGS. 4*a-d* necessitates two pieces: the contact and sealing piece I'''18 and the spring I'''22*d*. The piece I''''18 (FIG. 6*c*) includes a downwardly extending axial portion forming a skirt I''''18*f* that bears on and fits onto the central support I''''22*c* of the interface, thereby enabling absorption/compensation of any variations in the dimensions of the pieces (pump, etc.).

For simplicity the features and advantages of each system described above for the first time have not been systematically repeated in the description of subsequent systems using again all or part of that system. Of course these feature and advantages apply equally to the subsequent systems except in cases of technical incompatibility.

It will be noted that the filling interface of the various embodiments and variants described above can have different shapes and therefore different attachment pieces and mechanisms for fixing the inverted bottle and for fixing the source bottle, for example to adapt to different types of bottles. The attachment pieces and mechanisms from FIGS. 1*a* to 6*c* can thus be interchanged and used in the same interface: an interface (not shown) can include a mobile attachment piece or part of a first type for attaching the interface to a first bottle and a mobile attachment piece or part of a second type for attaching the interface to a second bottle. The lever or levers from FIGS. 3*a-b* are therefore in the upper part of the interface in order, when in the folded position (FIG. 3*b*), to cover the lever or levers from FIG. 2*c* in the lower part of the interface. An arrangement of this kind results in an order of unlocking between the bottles. For example, the interface can alternatively include an intermediate attachment part with one or more levers in its high or low part and an intermediate attachment piece that is screwed into the interface in the other part.

Figure 13C:
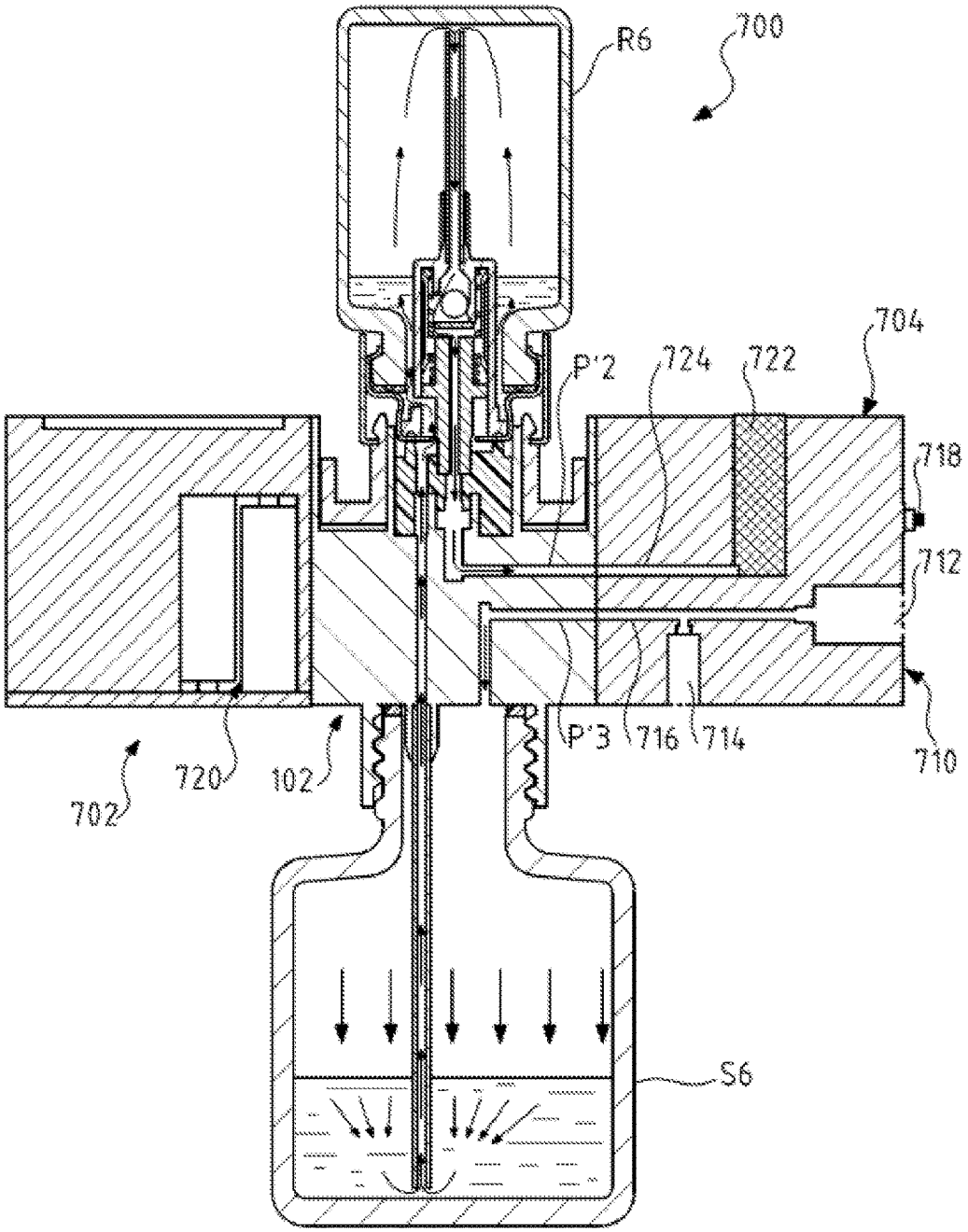
FIG. 13*c* shows diagrammatically a system according to a tenth embodiment of the invention for refilling a bottle.

FIGS. 7*a-b* and 8*a-b* show in axial section two possible examples of a device for injection of gas under pressure able to cooperate with any of the interfaces from the preceding Figures and FIGS. 13*a-c*.

The device 50 for injection of gas (here this is air) under pressure (FIGS. 7*a-b*) comprises an envelope 52 (e.g. a squeezable bulb) made from an elastically deformable material pierced in an area of its wall by a vent hole 54. The device includes in another area of the wall a rigid piece or end fitting 56 that extends away from the envelope and comprises an internal distribution duct 58. The duct 58 has a first end leading to the interior of the envelope and an opposite second end leading to the exterior of the envelope. The duct 58 therefore establishes communication between the interior and the exterior of the envelope. At rest, the envelope is in its expanded form from FIG. 7*a*, pressure equilibrium being established between the interior and the exterior of the envelope.

This device is for example used with the refilling system 10 from FIGS. 1*a-c* when it is operational (FIG. 1*c*). The end fitting 56 is moved toward the inlet orifice P3*a* of the gas passage P3 of the interface and the end 58*b* of the duct is engaged in that orifice or positioned against it. The user places their finger over the hole 54 in order to block the hole 54 and presses on the envelope 52 to expel via the duct 58 of the end fitting air contained in the envelope as indicated by the arrow G. This air under pressure is introduced into the interior of the passage P3 to fulfil the function described above: feeding air under pressure via the passage P3 to the first bottle S in order to bring about the transfer of liquid under pressure from said bottle to the second bottle R to be refilled via the interface.

When the user removes their finger from the hole 54 the injection of air under pressure ceases immediately (release of the residual air pressure in the bottle S), thus halting the filling of the inverted bottle R, but without being accompanied by any phenomenon of inertia in the system (the air continuing to expand and the liquid under pressure continuing to rise from the bottle S to the bottle R, etc.). This injection device is therefore particularly effective because it enables precise adjustment of the volume of liquid to be transferred from the bottle S to the bottle R (entirely by blocking and uncovering the hole 54 appropriately).

The device 60 for injection of gas (here this is air) under pressure (FIGS. 8*a-b*) comprises a rigid envelope 62 comprising a plurality of air passage orifices 62*a* in its external wall and enclosing:

an electric air pump 64, a switch 66 mounted on the pump, a contact member 68 passing through the wall of the envelope so that a part of it projects on the outside, the remaining part being retained in the envelope and mounted on an elastic member 70 (e.g. a leaf spring) which, in the absence of depression of the contact member, holds the latter against the internal face of the wall of the envelope (FIG. 8*a*), an end fitting 72 disposed in line with and fixed to the pump.

Figure 8A:
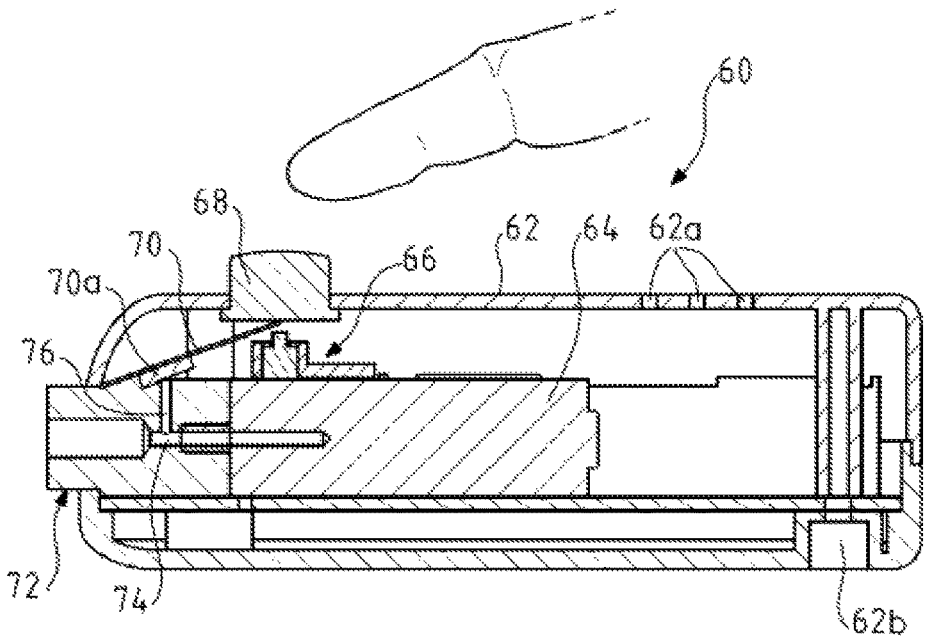
FIGS. 8*a* and 8*b* show a second possible example of a device for injecting gas under pressure cooperating with the interface from FIGS. 1*a-c;*
Figure 8B:
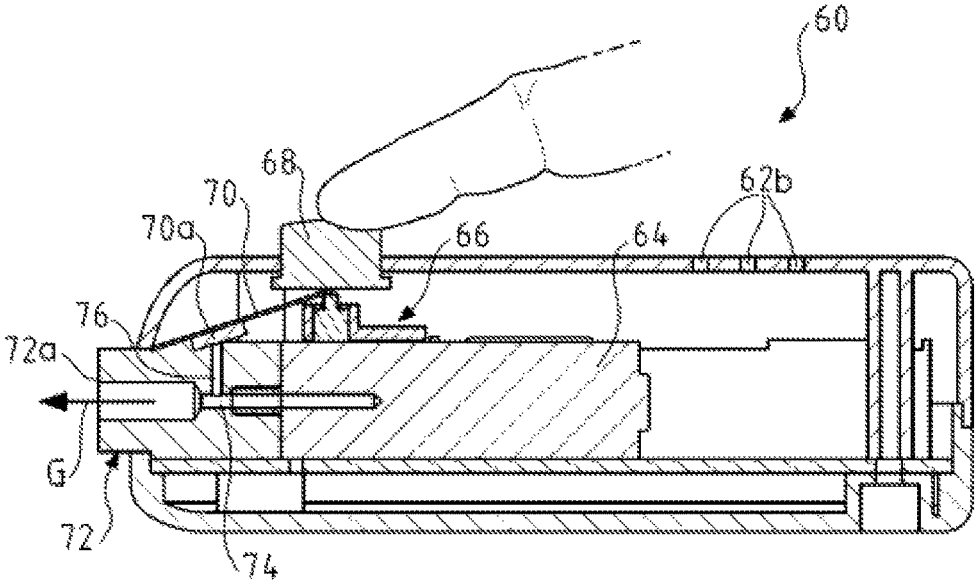

The envelope 62 is for example in two parts that are assembled together by means of a fixing (e.g. screwing) member placed in the hole 62*b* (FIG. 8*a*).

The end fitting comprises an axial central duct 74 communicating on the one hand with the interior of the pump 64 to receive therefrom the compressed air when the pump is actuated and on the other hand with the exterior of the device to expel this compressed air to the outside.

The end fitting 72 also comprises a lateral channel 76 extending from the lateral central duct to the interior of the envelope, more particularly in the direction of the elastic member 70 and a sealing and elastic element 70*a* carried by the latter. The element 70*a* can be deformed elastically by compression by an external stress and thereafter resume its initial shape when the stress is removed.

This device is for example used with the refilling system 10 from FIGS. 1*a-c* when the latter is operational (FIG. 1*c*). The end fitting 72 is moved toward the inlet orifice P3*a* of the gas passage P3 of the interface and the projecting end 72*a* of the end fitting is positioned against the latter so as to cause the duct 74 and the passage P3 to correspond axially. The user presses the contact member 68 down with their finger (FIG. 8*b*) and it comes into contact with the switch 66 for starting the pump 64 at the same time as compressing the elements 70*a* of the elastic member 70 and pressing it against the outlet orifice of the lateral channel 76, thereby blocking the latter. The air compressed by the pump is therefore forced to follow the duct 74 to exit from the end fitting 72 and enter the passage P3 from Figure is to fulfil the function described above and again with reference to FIGS. 7*a-b*.

When the user removes their finger from the contact member 68, it rises to the position from FIG. 8*a*, the elastic member 70 rises because of the shape restoring action of the element 70*a* and the pump 64 stops operating. The injection of air under pressure therefore ceases immediately (release of the residual air pressure in the bottle S), thus stopping the filling of the inverted bottle R, but without being accompanied by any phenomenon of inertia in the system (the air continuing to expand and the liquid under pressure continuing to rise from the bottle S to the bottle R, etc.). The air from the bottle S escapes from it via the passage P3 in which it rises and then follows the duct 74 to the end fitting the lateral channel 76 to escape into the envelope, which is open to the outside. This injection device is therefore particularly effective since it enables precise adjustment of the volume of liquid to be transferred from the bottle S to the bottle (entirely by blocking and releasing the hole 54 appropriately)

Figure 9:
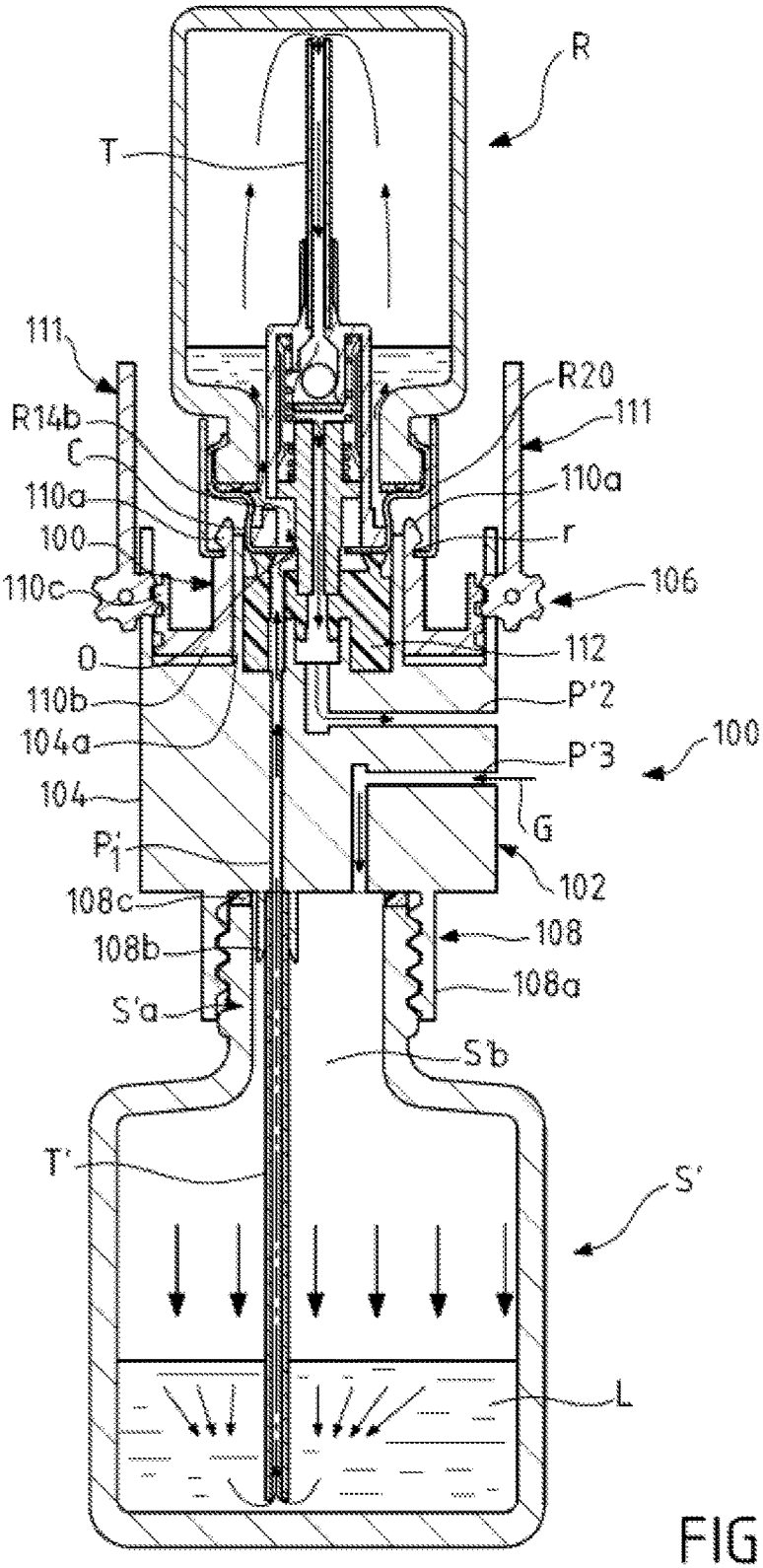
FIG. 9 shows a system according to a second embodiment of the invention for refilling a bottle.

FIG. 9 shows a system 100 according to a second embodiment of the invention for refilling a bottle in which the system is still in its first configuration as described above: a first bottle S' is situated at the bottom and an inverted second bottle R is situated above the first bottle with the filling interface 102 disposed between the two.

In this embodiment, the inverted second bottle R is still equipped with a pump and the interface is fixed to the bottle R so as to maintain the pump depressed in said bottle and said at least one vent orifice of the pump open. The first bottle S' containing liquid L does not include a pump, which makes it different from the first embodiment. The bottle S' is open at its upper end delimited by an external neck S'a surrounding the opening S'b.

The inverted bottle R is for example identical to that from FIGS. 1*a-c*.

The filling interface 102 includes a central block 104 and on either side thereof an upper part 106 and a lower part 108 respectively in contact with the inverted upper bottle R to be refilled and the lower source bottle S'. The upper part 106 is fixed to the inverted upper bottle by means of a mobile attachment part or piece identical to the part I""12 from FIGS. 2*a-c*.

The central block 104 integrates almost all of the passages P'1, P'2 and P'3 respectively similar to the passages P1, P2 and P3 from FIGS. 1*a-c*.

The upper part 106 of the interface comprises an attachment part or piece 110 comprising attachment members 110*a* carried by the internal periphery of an annular base 110*b* that is housed in a peripheral space open to the outside. The annular base 110*b* includes at its external periphery a cylindrical wall 110*c* provided with an external thread on its external face in order to cooperate with the toothed heads of two levers 111 (a single lever can be used instead). Like the piece I'12, the piece 110 is attached to the internal rim r of the pump cover piece R20 via the members 110*a*. It will be noted that for all the above embodiments and variants that have shown and described this way of attaching, the attachment to a bottle of an attachment piece that is connected (removably or not) to the interface can be effected differently on the pump cover, the capsule, or even directly on the bottle, thanks to other complementary attachment elements (not shown here) provided on or mounted on the bottle. The attachment piece 110 surrounds a contact and sealing piece 112 identical to the piece I'18 from FIGS. 2*a-c*.

In FIG. 9 the interface is in the attached and locked position from FIG. 2*c*: the levers are in the raised position and the locking axial extension or element 104*a* (identical to the element I'22*b* from FIG. 2*c*) is inserted between the members 110*a* and the external edge of the capsule C.

For its part the lower part 108 of the interface is simplified by virtue of the absence of a pump in the bottle S'.

The part 108 comprises a skirt 108*a* provided with an internal screwthread cooperating with the external screwthread of the neck S'a. The part 108 also comprises an ajutage 108*b* disposed in corresponding relationship with the liquid passage P'1 and in which a dip tube T' similar to the tube T of the bottle R is mounted through the opening S'b. A seal 108*c* is positioned between the upper edge of the neck S'a and the lower face of the central block 104.

The passage P'3 for feeding gas under pressure leads directly to the opening S'b.

In this embodiment the piece 110 of the interface is fixed and locked to the bottle as indicated above (here simply by clipping it on) so as to actuate the pump directly and permanently (depression of the pump and opening of the vent). As soon as the interface is firmly fixed in a sealed manner to the bottle R and to the bottle S' gas G under pressure can be injected into the passage P'3 via one of the devices from FIGS. 7*a*-8*b*. The gas (e.g. air) is fed to the interior of the bottle S' via the opening S'b and pressurizes the liquid to transfer it to the bottle R. The liquid under pressure rises in the tube T', the passage P'1, the passage portion included in the piece 112, the vent orifice O, the hole R14*b* and the interior of the bottle R to fill it. The air from the bottle R is expelled as already explained hereinabove via the tube T, the open pump and the passage P'3. The piece A from Figure is or a piece with the same function can also be provided here at the outlet from the passage P'2, as is moreover the case in the other embodiments and variants described above or hereinafter.

This system notably fits source bottles with an opening that can be uncovered (removal of the pump) without damaging the bottle.

It will be noted that the inverted bottle R can instead be any of the various shapes from the previous figures and the upper part of the filling interface can also be any of the various shapes shown in FIGS. 1*a-c*, 3*a-b*, 4*a-d*, 5*a-d* and 6*a-c*.

Figure 10A:
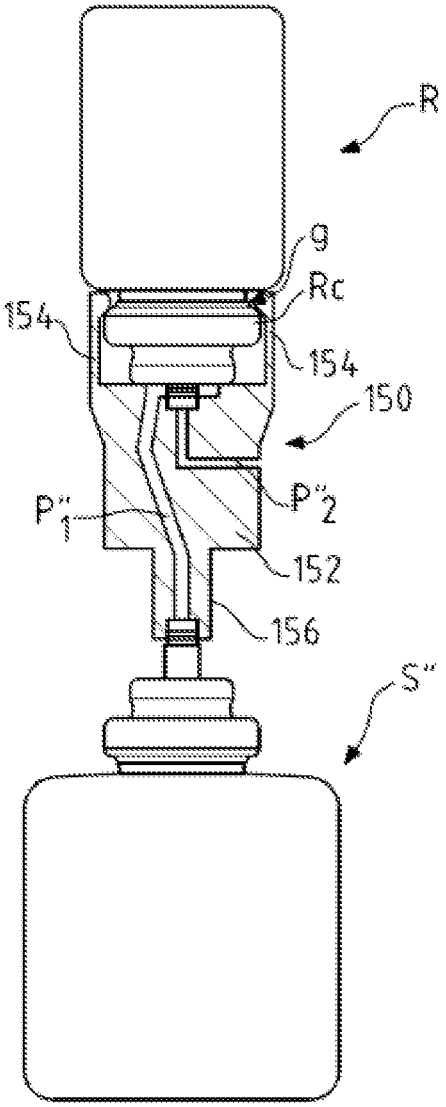
FIGS. 10*a* and 10*b* show a device according to a third embodiment of the invention for refilling a bottle.
Figure 10B:
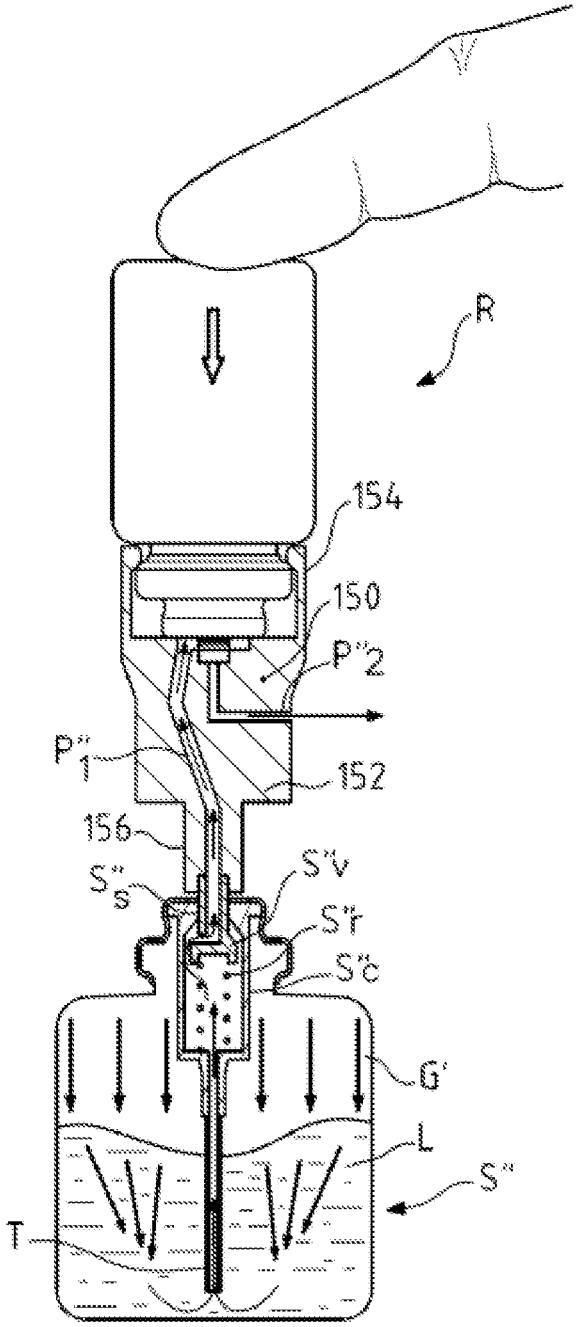

FIGS. 10*a-b* show a system according to a third embodiment of the invention for refilling a bottle in which the system is still in its first configuration as described above: a first bottle S" is situated at the bottom and an inverted second bottle R provided with a pump is situated above the first bottle with the filling interface 150 disposed between the two.

This system is simplified in that the interface 150 is fixed to the two bottles in a manner that allows relative movement between the bottle S" and the interface 150 along the direction of alignment of said bottles and the interface (here the vertical axis) when an external action (e.g. manual or non-manual bearing or pressing down) exerted in that direction. This external action is exerted for example by the finger of a user to operate the system when required. FIG. 10*a* corresponds to a waiting position.

The lower source bottle S" is provided with a valve closing the opening of said bottle and this bottle encloses a liquid and a gas G' stored under pressure. The (pressurized) gas G' is for example air or an inert gas in order not to degrade the composition of the liquid L. This gas is introduced in a conventional manner before use of the bottle as for example for a deodorant, insecticide, hair lacquer, spray etc.

The valve can be opened by an axial external action. As shown in FIG. 10*b* (valve in open position), the valve comprises for example a valve body S"c mounted in sealed manner in the upper opening of the bottle and a valve member S"v mounted on a spring S"r. In the absence of external force (which is the case here in FIG. 10*a*), the spring S"r holds the valve member S"v against its valve seat S"s disposed at the top and formed by the upper internal face of the valve body, thus closing any liquid outlet passage of the bottle. The lower part of the body S"c is extended by a dip tube t that extends to the vicinity of the bottom of the bottle.

The interface 150 comprises a central block 152 integrating some or all of the passages P"1 for transferring liquid from the bottle S" to the inverted bottle R and P"2 for evacuating air from the inverted bottle R. The inverted bottle R is for example identical to that from FIGS. 1*a-c*. However here it does not include a pump cover piece and the neck Rc can therefore be seen (FIG. 10*a*).

The interface 150 comprises at one of its two opposite ends attachment members 154 that for example clip around the external groove g situated at the base of the neck Rc of the bottle R and grip there thanks to the retaining function of the terminal ends of the attachment members 154. During this attachment, given the length of the members 154, the upper face of the interfaces depresses the pump of the bottle R as already described hereinabove. In the position from FIGS. 10*a-b* the interface is fixed to the bottle R so that the pump of the bottle is depressed permanently (pre-depressed pump) as for the embodiment from FIG. 9.

The interface 150 comprises at the opposite other end an open end the dimensions of which enable the projecting end of the valve of the bottle S" to be capped.

In the waiting position from FIG. 10*a* the valve is closed and the gas is maintained under pressure in a sealed manner in the bottle S".

When required, the user presses on the bottom of the inverted bottle R with their finger as indicated by the downward vertical arrow in FIG. 10*b*. The effect of this external action is to exert a vertical downward (axial) pressure on the valve of the lower bottle S", which compresses the spring S"r, moves the valve member S"v away from its valve seat S"s and opens the passage for the liquid under pressure from the bottle. The liquid maintained under the pressure of the gas is therefore forced to rise in the tube t, the body S"c and the valve member S"v and then to circulate in the passage P"1 of the interface in order to reach the vent orifice, the pump and the interior of the inverted bottle R.

The opening of the bottle S" allows the transfer of liquid from the first bottle S" to the inverted second bottle R following the release of the pressure of the internal gas G' that remains permanently in the bottle 5".

This fills the inverted bottle R and the air inside said bottle is evacuated via the dip tube, the pump and the passage P"2 as already explained hereinabove. The process of transferring liquid under pressure can be interrupted on command when the pressure of the finger of the user ceases, the effect of which is to cause the interface and the bottle R fixed to it to rise, thus closing the valve of the bottle S" and again maintaining the gas G' stored at a reduced pressure.

The external action on the system can therefore be exerted repeatedly over time.

According to a variant that is not shown, the filling interface is fixed to the inverted upper bottle without the pump being depressed. The latter is then depressed only when the user depresses the inverted bottle (FIG. 10*b*) to open the valve of the bottle S" simultaneously.

Figure 11A:
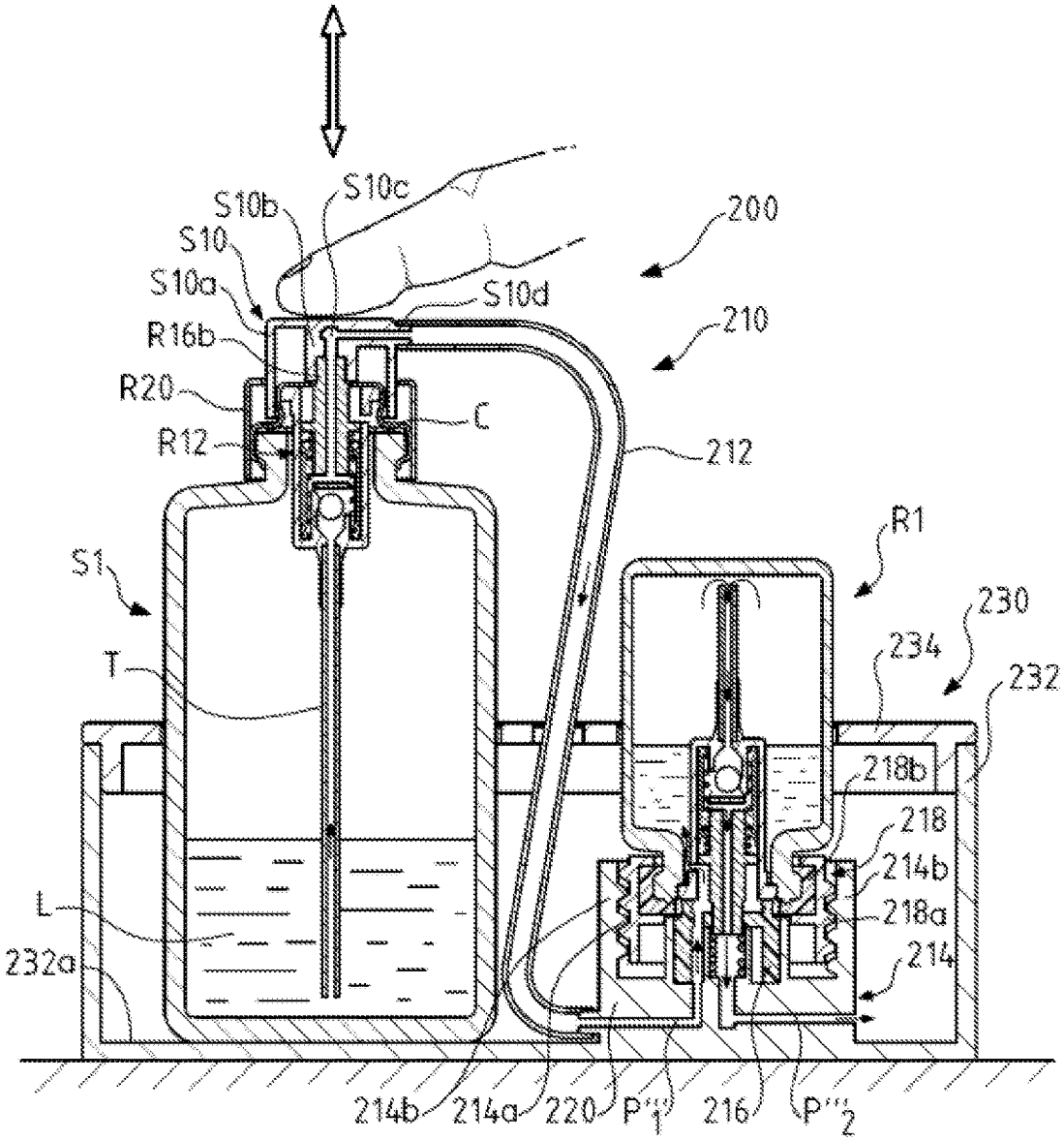
FIG. 11*a* shows a system according to a fourth embodiment of the invention for refilling a bottle.
Figure 11B:
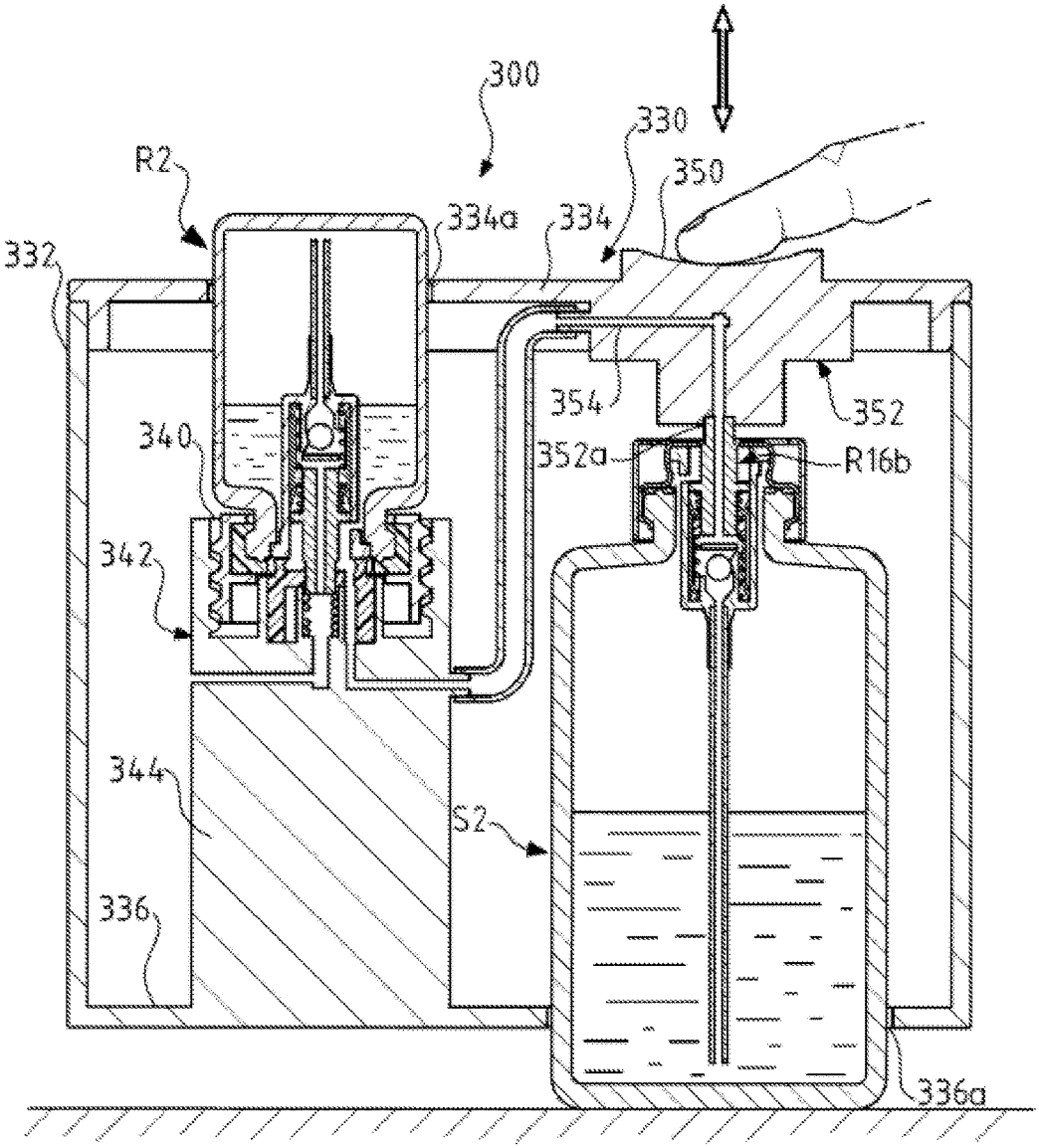
FIG. 11*b* shows a system according to a fifth embodiment of the invention for refilling a bottle.

As shown in FIGS. 11*a* and 11*b*, a system according to one embodiment of the invention for refilling a bottle can be configured with a first bottle situated alongside an inverted second bottle (second configuration) and not one above the other in an axial configuration. The bottom of the inverted second bottle can be disposed lower than the first bottle (FIG. 11*a*) or higher than the first bottle (FIG. 11*b*), or even at the same height (not shown).

FIG. 11*a* shows a configuration of a system 200 for refilling an inverted bottle R1 from a source bottle S1 (fourth embodiment). The bottles are connected to each other by a filling interface 210 that notably comprises a flexible pipe 212 extending between the two bottles.

The source bottle S1 is equipped with a pump R12 like the bottle S from FIGS. 1*a-c*, a capsule C and a pump cover piece R20, together with a dip tube T dipping into the liquid contained in this bottle.

The source bottle S1 has again all of the features of the bottle S and further comprises a button S10, for example a conventional button, that caps the upper end of the bottle. For example, the button includes a skirt S10*a* that is inserted in the annular space between the capsule C and the pump cover piece R20. The button caps the projecting end of the second portion R16*b* (hollow piston rod) with its central part S10*b* that encloses an internal channel S10*c* in corresponding relationship with the interior of the piston R16*b* and exits on the side of the button. The button S10 also includes at the outlet of the channel a projecting outlet end S10*b* to which one end of the pipe 212 is fixed.

The opposite end of the pipe 212 is fixed to an interface part 214 to which is removably attached the inverted bottle R1 to be refilled.

This bottle has the same features as the bottle R' from FIGS. 4*a-d* and the bottle S1 (pump, dip tube, etc. but neither capsule nor pump cover piece).

In the example shown the bottle R1 is for example smaller than the source bottle S1, although this is no way obligatory.

The system 200 comprises an interface part 214 that is identical to the upper part of the interface I''' from FIGS. 4*a-d* in that it comprises a hollow body open in its upper part to receive on the one hand in its central part a contact and sealing piece 216 identical to the piece I'''18 and on the other hand around the piece 216 an annular intermediate attachment part 218 identical to the part B10. This piece 218 is provided at its external periphery with an external screwthread 218*a* cooperating with a complementary internal screwthread 214*a* of a cylindrical wall 214*b* delimiting the void of the interface body externally. This piece 218 is provided at its internal periphery with pads 218*b* of a for example elastomer material identical to the pads B12. This attachment of the interface to the bottle R1 via the piece 218 enables the interface to be fixed and locked to the bottle so as to maintain the pump of the bottle permanently depressed.

The interface part 214 comprises a plinth or base 220 into which are integrated a passage P'''1 for feeding liquid under pressure to the pump of the bottle R1 and a passage P'''2 for evacuation of air from the bottle R1 by the action of filling said bottle with the liquid transferred under pressure from the bottle S1.

Here the interface 210 comprises the flexible pipe 212 and the interface part 214.

In the example shown a part of the system 200 is housed in a casing or box 230 comprising an open hollow body that is closed by a cap 234 that is not sealed. Through-openings are provided in the cap for the passage of the bottles S1 and R1 and the flexible pipe 212. Here an upper part of each of the bottles S1 and R1 and the pipe 212 projects above the cap. However, the height of the vertical walls of the casing can be different and notably greater, thus concealing all or part of the body of the bottles and for example allowing only the button S10 and the upper end of the pipe 212 to be seen. The openings are suited to the external dimensions of the bottles and the pipe in order to facilitate their insertion from above. In particular, the bottle R1 is easily installed in the interface part 214 by simple vertical movement in translation of said bottle through the corresponding opening in the cap 234. In this example the source bottle S1 that is more bulky and heavier than the bottle R1 can simply be placed on the bottom of the casing without being fixed to it. In a variant that is not shown it can nevertheless be fixed to the bottom or to another part of the casing.

Using the system 200 installed in this way is particularly easy since it suffices for the user to press on the button S10 successively, as indicated by the vertical arrow, to aspirate liquid by pumping (creating a reduced pressure in the tube), and then to transfer the liquid under pressure through the pump, the button, the pipe 212, the passage P'''1, the pump of the bottle R1 and the interior of the latter. The air contained in the latter is evacuated via the pump and the passage P'''2 as the liquid is transferred. When the user ceases to press, the button and the pump rise, interrupting the transfer of liquid by aspiration of the liquid by pumping. Filling the bottle R1 therefore proves particularly simple and accurate.

Upon successive pressings of the button S10 by the user a movement in vertical translation between the two bottles is effected. The travel of the button is absorbed by the flexibility of the pipe 212.

It be noted that the base 220 of the interface part 214 is for example in one piece with the bottom 232*a* of the body 232. However, in accordance with a variant that is not shown, the interface 214 can be separate from the bottom.

It should be noted that the attachment part of the interface part 214 can differ from that shown and for example take one of the forms from FIGS. 5*a* to 6*c*. The bottles S1 and R1 can also be different and optionally include a pump cover and/or a capsule depending on the applications envisaged and the types of bottle.

FIG. 11*b* shows a fifth embodiment of a system 300 for refilling an inverted bottle R2 from a source bottle S2. This system is very similar to the system 200 but differs from it in that the source bottle S2 is lower than the inverted bottle R2.

The system is partially housed inside a body 332 of a box or casing 330 closed by a lid 334 that is not sealed.

An upper opening 334*a* in the lid 334 enables the inverted bottle R2 to be introduced from above and fixed to the attachment part 340 of the interface part 342. The attachment part 340 is identical to the part 218 from FIG. 11*a* and the interface part 342 comprises a base 344 higher than the base 220 in order to raise the interface part 342 and therefore the bottle R2. The remarks made in respect of FIG. 11*a* also apply here.

The casing has an opening in the bottom 336 and an opening 336*a* is therefore provided to enable the bottle S2 to be engaged therein and introduced into the casing.

The lid 334 is configured as a button in an area situated alongside the opening 334*a* with an actuating member 350 on the upper (exterior) face of the lid. The button is extended inside the casing by a base 352 that integrates an internal channel 354 analogous to the channel S10*c* from FIG. 11*a*.

A for example flexible pipe 360 analogous to the pipe 212 connects the interface part 342 to the outlet end of the internal channel 354. The base 352 of the button has on its lower face a housing 352*a* adapted to receive the end of the hollow rod R16*b* of the pump of the bottle S2 when said bottle is introduced into the casing via the bottom opening 336*a*.

In the FIG. 11*b* position the user has only successively to depress/release the pressure on the member 350 as indicated by the vertical arrow to cause the casing 330 and therefore the bottle S2 that is fixed to it to descend/rise and thus to actuate the pump of the bottle S2 (depression/rising of the pump).

As for the embodiment from FIG. 11*a*, the transfer of liquid under pressure is interrupted when pressing ceases.

The embodiments from FIGS. 11*a* and 11*b* prove easy to use (for example with one hand) and conceal most of the mechanisms of the systems thanks to a casing in which are formed housings to receive the bottles, which makes these embodiments particularly beneficial for certain applications. These embodiments can also be applied to configurations with more than two bottles (e.g. a source bottle and two or more than two bottles to be refilled, or even a bottle to be refilled and two or more than two source bottles).

Figure 12A:
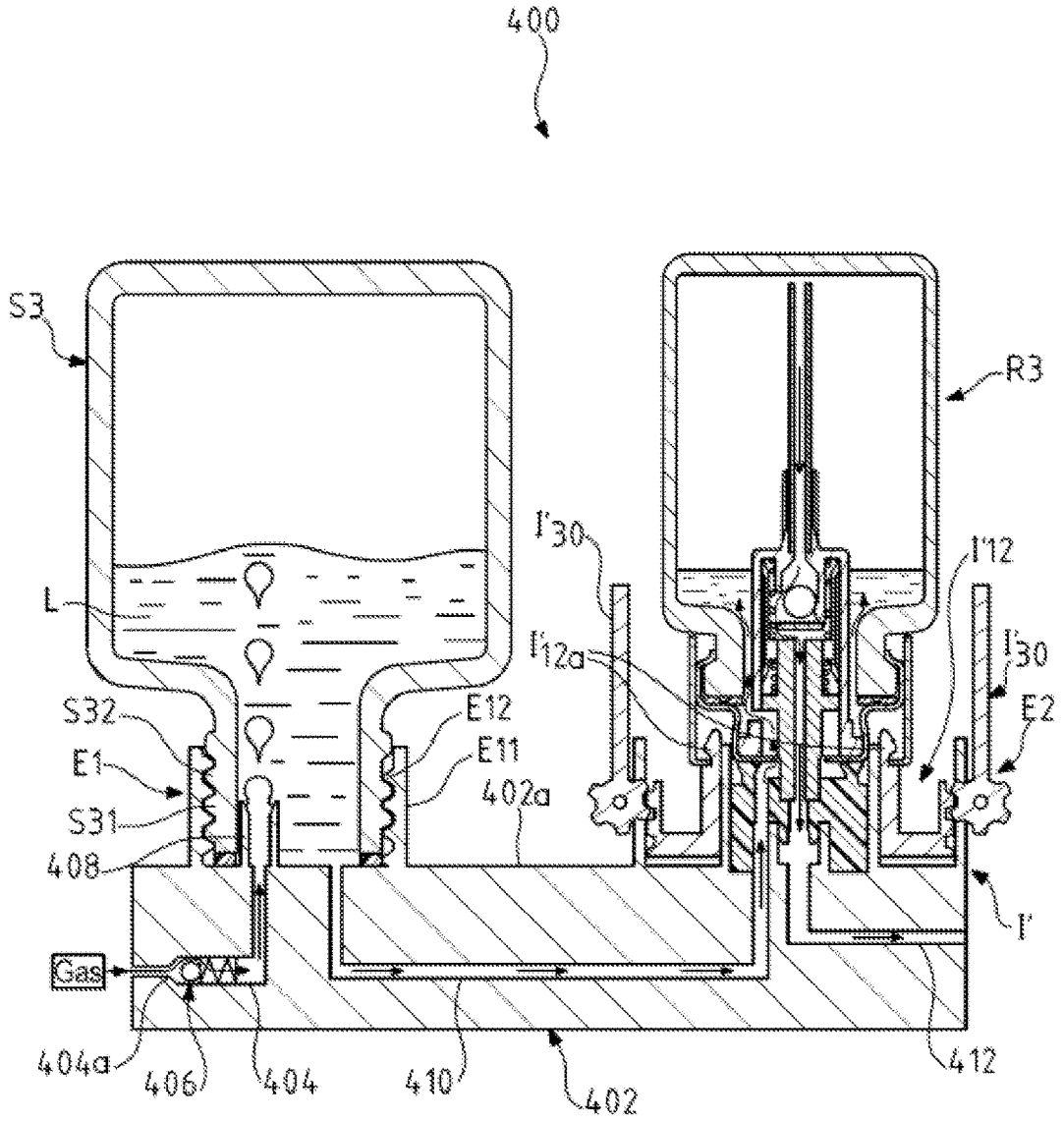
FIG. 12*a* shows a system according to a sixth embodiment of the invention for refilling a bottle.

A system 400 according to a sixth embodiment for filling a bottle is shown in FIG. 12*a* in the second configuration in which the source bottle S3 and the bottle R3 to be refilled are side by side. Here the source bottle S3 containing the liquid L is also inverted and includes no dip tube and no pump. The two bottles are at substantially the same height although this is not obligatory.

The source bottle S3 and the bottle R3 to be refilled are both mounted on a support or base 402 that serves as the filling interface connecting the bottles fluidically and mechanically. In the example shown the source bottle has a greater volume than the bottle to be refilled but this is not obligatory.

The filling interface 402 includes on a horizontal upper face 402*a* two horizontally spaced locations E1, E2 each of which is configured to receive one of the bottles.

The first location E1 is formed by a hollow element E11 to receive the bottle S3 that projects relative to the upper face 402*a*. The hollow element E11 includes an internal screwthread E12 into which the external screwthread S32 of the neck S31 of the bottle S3 is screwed. The element E11 forms a bush which is for example integrated into the interface. The element E11 has for example a hollow cylindrical shape.

The interface 402 comprises a passage 404 for feeding a gas G under pressure from a gas source that is not shown (the source optionally forms part of the interface and more generally of the system). This passage 404 integrates a valve 406 formed for example of a ball mounted on a spring and that blocks an orifice 404*a* of the passage in the absence of injection of gas into the passage.

This passage 404 opens onto the upper face 402*a* and is extended above that face by a chimney 408 that penetrates into the bush E11 and the neck S31 when the bottle is screwed into the bush E11.

The location E2 includes, integrated into the interface 402, for example above the face 402*a*, the filling interface shown in FIGS. 2*a-c* with the two levers I'30 and the attachment part I'12 equipped with its attachment members I'12*a*. This interface I' is matched to the level of the meshing of the levers with the part I'12 so that the bottle is inserted and locked in the interface I' by pivoting the levers through an angle of 90° rather than 180° as in FIGS. 2*a-c*. For this it suffices to adapt the number of teeth of the meshing mechanism.

The interface 402 also comprises a passage 410 that extends from a first end flush with the face 402*a* to the interior of the bush E11 (and of the neck S31 when the bottle is screwed into the bush E11) as far as the interface I' of the location E2. This passage 410 is used to transfer liquid from the source bottle S3 to the bottle R3 to be refilled.

The interface also comprises a passage 412 for evacuating to the outside gas (here air) from the bottle R3 to be refilled.

Here the passages 404, 410 and 412 are integrated into the body of the filling interface 402 but other possible arrangements can be envisaged.

The operation of the system is very simple since it is the injection of gas under pressure into the passage 404 that increases the pressure inside the source bottle S3 (above the liquid) and triggers the transfer of liquid under pressure from the source bottle S3 to the bottle R3 to be refilled and the evacuation of the air from the latter to the outside, as indicated by the arrows in FIG. 12*a*. The transfer of the liquid is interrupted as soon as the injection of gas ceases.

Feeding gas (e.g. air) into the filling interface 402 can be effected for example by one of the pumping devices shown in FIGS. 7*a-b*, 8*a-b*. The feeding of gas can alternatively be effected by some other means such as a reservoir of gas under pressure associated with a valve with the combination connected to the inlet of the passage 404. The valve can for example be mounted on the reservoir or on the downstream side thereof in a circuit connecting the reservoir to the valve. Such means for injection of gas under pressure with no pumping device can also be used with the embodiments described above apart from that from FIGS. 10*a-b*.

Figure 12B:
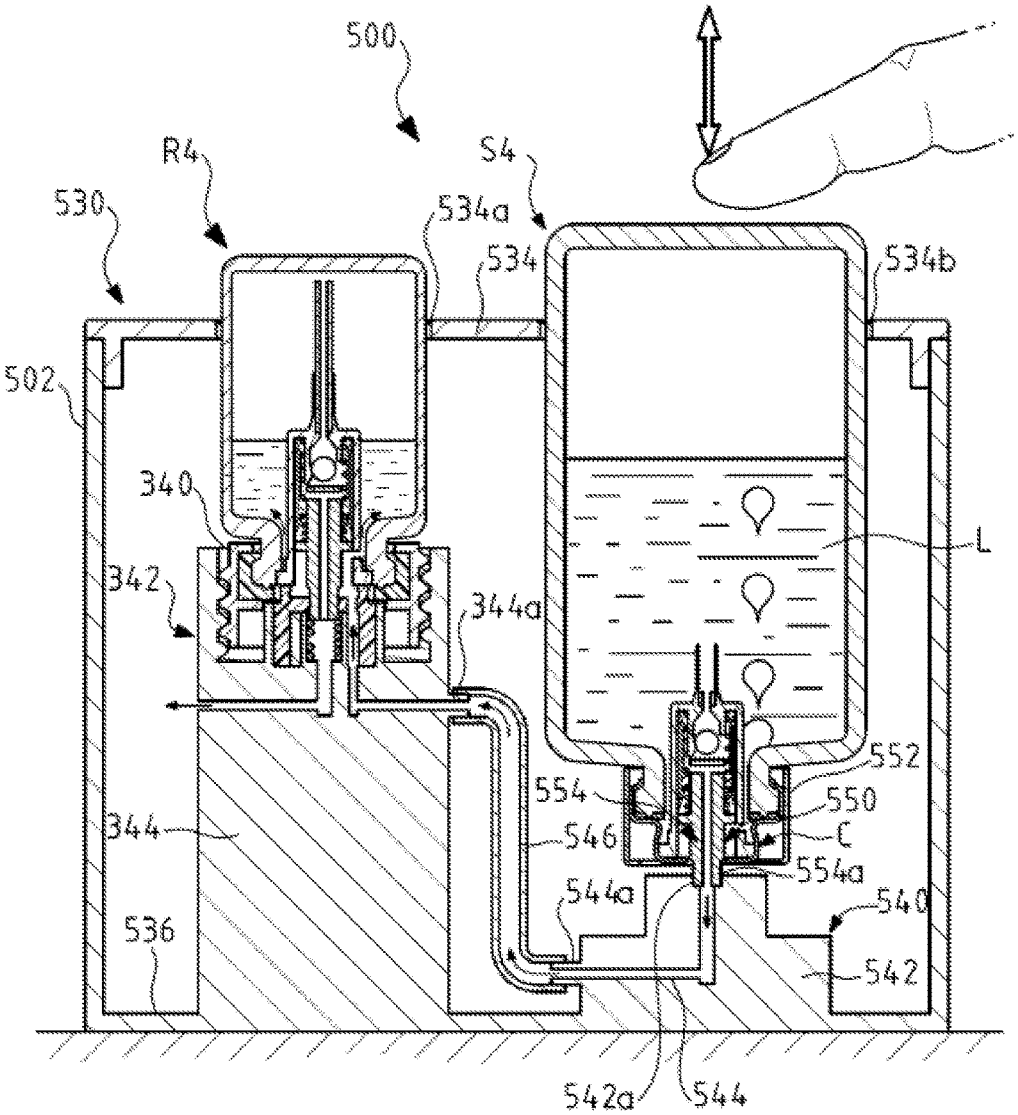
FIG. 12*b* shows a system according to a seventh embodiment of the invention for refilling a bottle.

A system 500 according to a seventh embodiment of the invention for refilling a bottle is shown in FIG. 12*b* in the second configuration in which the source bottle S4 and the bottle R4 to be refilled are side by side. Here the source bottle S4 containing the liquid L is also inverted and includes no dip tube but does include a pump. This system is identical to that from FIG. 11*b* where the bottle R4 to be refilled is concerned and this part of the system will therefore not be described in detail again.

As for the system 300, the system 500 is partly housed inside a body 502 of a casing or box 530 closed by a lid 534 that is not sealed.

Two upper openings 534*a*, 534*b* in the lid 534 enable the two inverted bottles R4 and S4 respectively to be introduced from above and fixed to the interior of the body 502:

- to the attachment part 340 of the interface part 342 in the case of the bottle R4 (as in FIG. 11*b*),
- to an attachment part 540 fixed to the closed bottle 536 of the body 502 in the case of the bottle S4.

The attachment part 540 is part of the filling interface of the system in the same way as the interface part 342 and comprises a base 542 lower than the base 344 that includes an internal passage 544 for the liquid. The two bases 344 and 544 are connected to each other by a pipe 546 (pipe for the passage of liquid) that is for example force-fitted in sealed manner onto two respective ajutages 344*a* and 544*a* fastened to the bases. The base 542 is shown with a shoulder but this is not necessary.

The passage 544 extends from the ajutage 544*a* situated at one end of the passage to an opposite end that leads onto the upper face of the base 542. It will be noted that the ajutage is on one of the flanks of the base but it could be disposed elsewhere. The passage 544 forms an elbow bend and therefore has the shape of an L on its side in this example.

The source bottle S4 is equipped with a pump 550 here mounted in a non-demountable manner on the bottle by means of a crimped capsule C (in a variant the pump is mounted in a demountable manner). A piece 552 forming a pump cover is mounted around the capsule and the neck of the bottle. These elements and the bottle as a whole are identical to those described with reference to FIGS. 1*a-c* and will therefore not be described in more detail here.

Like the pump R12 from FIGS. 1*a-c*, the pump 550 comprises a mobile part (piston) the end 554*a* of which projecting above the pump cover 552 is configured to be inserted into a housing 542*a* of the base 542. This housing surrounds the outlet end of the passage 544. The interior of the piston is therefore in communication with the passage 544.

In the FIG. 12*b* position the user (whose finger is seen) has pressed vertically on the bottom of the bottle S4 that projects from the casing 530 in order to actuate the pump 550 inside the bottle (depression/rising of the pump). The piston is therefore depressed and the vent orifice or orifices opened (like the pumps of the two bottles in FIGS. 1*b* and 1*c*), which allows the liquid to flow from the source bottle S4 into the passage 544 via the pump. The liquid is therefore fed under pressure via the pipe 546 to the interface part 342 and then into the bottle R4 to be refilled by the same mechanism as already described. No injection of gas is used here.

As for the embodiment from FIG. 11*b*, when the bottle S4 is no longer depressed, the bottle rises vertically (as shown by the arrow) and its pump returns to the non-depressed position, thus blocking the passage for the liquid (see the position of the pumps in FIG. 1*a*). The transfer of the liquid under pressure is interrupted.

The user has only successively to press on the bottle/release the pressure as indicated by the vertical double-headed arrow to cause the bottle to descend/rise and thus to actuate/release the pump of the bottle S4.

The FIG. 13*a* refilling system 600 broadly comprises:

- a source bottle S5 containing liquid disposed at the location (head of the bottle at the top as for the embodiments from FIGS. 1*a* to 11*b*; however, in a variant that is not shown, the source bottle can be inverted, for example as in the embodiments from FIGS. 12*a-b*);
- a bottle R5 to be refilled which is inverted as in all the previous figures;
- a device 610 that is configured to deliver/supply gas under pressure to the source bottle S5;
- a filling interface 620 that comprises:

a liquid passage 622 connecting the two bottles fluidically and mechanically for the transfer of liquid under pressure from the bottle S5 to the inverted bottle R5 via said at least one open vent orifice (not shown in the figure) of the pump of the bottle R5, a gas passage 624 for feeding gas under pressure to the source bottle, and a gas (generally air) passage 626 for the evacuation of the gas contained in the bottle to be refilled during the refilling operation.

The device 610 comprises a pumping device 612 for pressurizing the gas coming from a gas source (e.g. reservoir or open air) 614 and a valve 616 connected to the passage 624 (e.g. via a connector 624*a*). The source 614 shown in dashed line can optionally be part of the device 610. The pumping device 612 is for example of the manual type, for example of the type from FIGS. 7*a-b*, or of the electrical type, for example of the type from FIGS. 8*a-b* that includes an electric pump. The valve 616 is configured in a first state not open to the outside so as not to interrupt the feeding of gas under pressure in the passage 624 as far as the bottle S5 (this gas is pressurized by the pumping device when the latter is actuated). When the valve 616 is in a second state open to the outside (the passage from one state to the other is commanded manually or electrically), the pressure in the passage 624 and in the source bottle S5 falls and balances with the atmospheric pressure, which interrupts the injection/feeding of gas under pressure into the source bottle S5. The pumping device 612 has generally also ceased to operate when the valve 616 goes to this second state. The valve is for example a solenoid valve that is driven electrically.

Actuation of the valve 616 into the second state therefore enables immediate interruption of the transfer of liquid under pressure from the source bottle S5 to the bottle R5 to be refilled and thus filling of the latter. In the absence of valve 616, filling continues even when the pumping device ceases to operate because the compressible air generates an inertia phenomenon.

The refilling system 650 from FIG. 13*b* shows diagrammatically another embodiment in which the elements of FIG. 13*a* are used again identically except where the device 610 is concerned.

Indeed, the refilling system 650 comprises a device 660 configured to deliver/supply gas under pressure to the source bottle S5 using a reservoir 662 of gas under pressure.

The reservoir 662 of gas under pressure is adapted to supply gas under pressure to the passage 624 and to the source bottle S5.

The device 660 comprises a first valve 664 which, depending on its state (commanded manually or electrically): open or closed, allows feeding of gas under pressure coming from the reservoir 662 into the passage 624 and into the source bottle S5 or prevents that feeding. This valve can be mounted directly on the reservoir or at a distance therefrom (the valve is for example placed on a pipe connected to the reservoir and on the downstream side thereof in the gas flow direction; the pipe between the reservoir 662 and the valve 664 can optionally form part of the gas passage 624) depending on the required configurations. The valve 664 can be a manual valve or driven electrically.

The device 660 also comprises a second valve, namely the valve 616 already described with reference to FIG. 13*a*. When this valve is open (first state) it enables feeding of gas to the source bottle S5 via the passage 624 and when it is closed (second state) it prevents the supply of gas under pressure to the source bottle S5 via the passage 624.

The second valve 616 is generally open to the outside when the first valve 664 is closed (to interrupt suddenly the transfer of liquid under pressure between the bottles) and conversely it is closed when the first valve 664 is open (to cause the transfer of liquid under pressure between the bottles).

The device 610 (FIG. 13*a*) or 660 (FIG. 13*b*), regardless of its configuration, can optionally be integrated into the filling interface of the system. In FIGS. 7*a-b*, 8*a-b* the device is for example separate from the interface.

In FIG. 13*c*, the device is at least partly integrated into the filling interface.

This figure shows a refilling system 700 according to another embodiment of the invention.

This system repeats the system 100 from FIG. 9 with a source bottle S6 with no pump in the head at the top position, an inverted bottle R6 to be refilled, and a filling interface 702 that comprises on the one hand the interface 102 from FIG. 9 and on the other hand an extension 704 of that interface. This extension 704 receives a pumping device 710 comprising an electric pump 712 (for example an air pump) and a valve 714 both of which are mounted so as to be connected to the gas passage 716 (as in FIG. 13*a*) connected to the passage P'3 leading directly to the interior of the bottle S6.

A member 718 for actuating the pump 712 such as an on/off button on an external face of the interface enables the pump to be operated. As soon as the pump 712 is stopped, the valve 714 is automatically open to the outside in order to terminate filling rapidly (the two members 712 and 714 are for example electrically connected to each other).

The interface 702 also comprises an electrical power supply for the pump and the valve (which here is a solenoid valve) that is formed of cells or batteries 720. The connections between the power supply system 720 and the members 712, 714 of the interface are not shown in the section plane.

An (optional) absorbent material 722 is disposed on the gas (air) evacuation passage 724 that extends the passage P'2 in the interface extension 704. This material enables absorption of the liquid in the event of unwanted exit of the liquid from the bottle R6 via the gas evacuation passage.

In the FIG. 13*c* embodiment the interface extension 704 takes for example the shape of a belt surrounding and fixed to the interface part 102. However, the interface 702 could be formed in one piece.

The interface extension can alternatively take some other form. It will also be noted that the part 102 of the filling interface that receives the bottles R6 and S6 can alternatively have a shape different from that shown here, notably with other means for fixing the bottle.

Moreover, according to a variant that is not shown, the interface extension 704 can receive instead of the pump 712 a reservoir of gas under pressure (e.g. air or inert gas) equipped with a valve fulfilling the functions of the valve 664 from FIG. 13*b*.

The invention claimed is:

1. System for refilling a bottle with liquid, wherein said system comprises:

at least one first bottle containing liquid and comprising a bottom at one end and an opening for the exit of the liquid from the bottle at an opposite end, at least one second bottle to be refilled with the liquid from the first bottle, the second bottle comprising a bottom at one end and a pump mounted on the bottle at an opposite end, the pump being equipped with at least one vent orifice that can be open or closed depending on the position of the pump, the second bottle being in an inverted position with the pump situated below the bottom of said bottle, a filling interface connecting the two bottles, the interface comprising, on the one hand, at least one liquid passage disposed between the two bottles for the transfer of the liquid under pressure from the first bottle to the inverted second bottle via said at least one open vent orifice of the pump of said second bottle and, on the other hand, at least one gas passage for the evacuation of the gas contained in the inverted second bottle to the exterior of said bottle.

2. System according to claim 1, wherein the interface is fixed to the first bottle and/or to the inverted second bottle.

3. System according to claim 2, wherein the interface is fixed to the inverted second bottle so as to maintain the pump inserted in said bottle and said at least one vent orifice open.

4. System according to any one of claim 1, wherein the first bottle comprises a pump mounted on said bottle at the level of the opening, the pump being equipped with at least one vent orifice that can be open or closed depending on the position of the pump.

5. System according to claim 2 and wherein the interface is fixed to the first bottle so as to maintain the pump of said bottle depressed in the latter and said at least one vent orifice open.

6. System according to claim 1 wherein the interface comprises a first attachment part that is fixed to the first bottle and a second attachment part that is fixed to the inverted second bottle, the two attachment parts being mobile relative to the interface.

7. System according to claim 1 wherein the interface is in communication with a dip tube that extends inside the first bottle and in the direction of the bottom of said bottle.

8. System according to claim 1, wherein the interface comprises at least one gas passage for feeding a gas under pressure to the first bottle (S).

9. System according to claim 8 wherein said system comprises at least one device that is configured to deliver gas under pressure.

10. System according to claim 9 wherein said at least one device configured to deliver gas under pressure comprises a pumping device for pressurizing the gas or a reservoir containing gas under pressure.

11. System according to claim 8 wherein the system comprises a valve that is configured to establish communication with the outside air, on command, of said at least one gas passage that extends to the first bottle.

12. System according to claim 2 wherein the interface is fixed to the inverted second bottle and to the first bottle so as to allow relative movement between the two bottles along the direction of alignment of said bottles and the interface when an external action is exerted in that direction.

13. System according to any one of claims 1 to 12 characterized in that the first bottle (S) is equipped with a valve closing the opening and enclosing liquid and a gas under pressure in the bottle, the valve being adapted to be opened by an external action, thus allowing the pressure of the gas to transfer liquid from the first bottle (S) to the inverted second bottle (R).

14. System according to claim 1 wherein the interface is disposed between the two bottles.

15. System according to claim 14 wherein the interface is disposed between the first bottle and the inverted second bottle disposed above the first bottle.

16. System according to claim 1 wherein the interface comprises a casing in which are formed housings intended to receive the two bottles.

17. Method of refilling a bottle with liquid wherein the method is executed by a system that comprises:

a first bottle containing liquid and comprising a bottom at one end and an opening for the passage of the liquid at an opposite end, a second bottle to be refilled with the liquid from the first bottle and which comprises a bottom at one end and a pump mounted on the bottle at an opposite end, the pump being equipped with at least one vent orifice that can be open or closed depending on the position of the pump, the second bottle being in an inverted position so that the pump is situated below the bottom of the second bottle, the method comprising:

opening said at least one vent orifice by depressing the pump in the inverted second bottle, creating an increased pressure or a reduced pressure in the first bottle so as, when the opening of the first bottle allows the liquid to exit said bottle, to cause the transfer of the liquid under pressure from the first bottle to the inverted second bottle and the filling of said inverted second bottle via said at least one open vent orifice, evacuating the gas contained in the inverted second bottle to the outside via the pump.

18. Method according to claim 17 wherein said at least one vent orifice is opened by an external action applied to the pump of the inverted second bottle.

19. Method according to claim 18, wherein the external action is applied permanently in order to maintain the pump in the inverted second bottle depressed during the refilling of said bottle.

20. Method according to claim 18, wherein the external action is applied repeatedly in order successively to depress the pump in the inverted second bottle during the refilling of said bottle.

21. Method according to claim 17 wherein an increased pressure is created in the first bottle by injection of a gas under pressure into the first bottle.

* * * * *